US006520135B2

(12) United States Patent
Sugawara

(10) Patent No.: US 6,520,135 B2
(45) Date of Patent: Feb. 18, 2003

(54) APPARATUS FOR ADJUSTING VALVE LIFT

(75) Inventor: Masafumi Sugawara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/962,343

(22) Filed: Sep. 26, 2001

(65) Prior Publication Data

US 2002/0152974 A1 Oct. 24, 2002

(30) Foreign Application Priority Data

Apr. 20, 2001 (JP) ..... 2001-123293

(51) Int. Cl.[7] ..... F01L 1/14

(52) U.S. Cl. ..... 123/90.48; 123/90.16; 123/90.17; 123/90.52; 123/90.55

(58) Field of Search ..... 123/90.16, 90.48, 123/90.33, 90.55, 90.52

(56) References Cited

U.S. PATENT DOCUMENTS

| | | | | | |
|---|---|---|---|---|---|
| RE32,167 | E | * | 6/1986 | Buente | 123/90.55 |
| 5,694,894 | A | * | 12/1997 | Allen | 123/198 F |
| 6,076,491 | A | * | 6/2000 | Allen | 123/198 F |

FOREIGN PATENT DOCUMENTS

| | | | | |
|---|---|---|---|---|
| DE | 1958267 | | 6/1971 | |
| JP | 2563713 | | 9/1996 | |
| JP | 10-141030 | | 5/1998 | |
| JP | 10169422 | A * | 6/1998 | ..... F01L/13/00 |
| JP | 10-507242 | | 7/1998 | |
| JP | 2000136703 | A * | 5/2000 | ..... F01L/01/14 |
| JP | 200-510546 | | 8/2000 | |

* cited by examiner

*Primary Examiner*—Thomas Denion
*Assistant Examiner*—Ching Chang
(74) *Attorney, Agent, or Firm*—Sughrue Mion, PLLC

(57) ABSTRACT

An apparatus for adjusting valve lift (VVL apparatus) is made up of a substantially cylindrical tappet casing having on an upper end thereof a cam contact portion which comes into contact with a cam which is provided on a camshaft and which has a high lift cam profile; an outer tube coaxially disposed inside the tappet casing; an inner tube coaxially disposed inside the outer tube so as to be axially slidable and circumferentially rotatable; and a helical spring which is disposed between the inner tube and the tappet casing and which constantly urges the inner tube in a direction of increasing an amount of axial displacement of an intake valve. A ramp groove with which pins of the inner tube are engaged is an arcuate groove having a curve of secondary degree. Collision noises in low lift mode are thus arranged to be adequately absorbed. Silence at a low engine speed can therefore be secured and the number of parts is reduced and the weight of the VVL apparatus is reduced.

19 Claims, 17 Drawing Sheets

B
26
51
36
COLLISION NOISES
35
18
COLLISION NOISES
COLLISION NOISES
VALVE CLOSED
VALVE LIFT AMOUNT MAXIMUM
START OF VALVE LIFTING

APPARATUS FOR ADJUSTING VALVE LIFT

BACKGROUND OF THE INVENTION

1. Field of the Invention

The present invention relates to an apparatus for adjusting a valve lift (hereinafter called as a variable valve lifting, VVL, apparatus) which is used in a direct-strike type of valve driving system in which a tappet is directly stricken by a cam when an intake valve or an exhaust valve (hereinafter referred to as a valve altogether) of an internal combustion engine (hereinafter called an engine) is opened or closed, in which an amount of valve lifting (hereinafter called a valve lift amount) is adjusted by changing an axial length of the tappet.

2. Description of the Prior Art

FIG. 24 is a schematic view showing an arrangement of a general valve system of an engine. FIG. 25 is a view as seen in the direction of arrows A—A showing an arrangement of cams on a camshaft in the valve driving system in FIG. 24. FIG. 26 is a front view showing a profile of the cam in FIG. 25. FIGS. 27A through 27G are schematic sectional views to show a conventional valve opening movement and valve closing movement of the VVL apparatus shown in FIG. 24 in a low lift mode, and FIG. 27H is a graph continuously showing the change in the valve lift amount. FIGS. 28A through 28G are schematic sectional views to show the conventional valve opening movement and valve closing movement of the VVL apparatus shown in FIG. 24 in a high lift mode, and FIG. 28H is a graph continuously showing the change in the valve lift amount.

In the example given hereinbelow, only the valve driving system on the intake side is shown out of the valve driving system for each of the intake side and the exhaust side. Since the valve driving system on the exhaust side has basically the same arrangement, an explanation thereabout is omitted. In addition, explanations are made hereinbelow based on the presumption that the cylinders in the figures are disposed in a vertical direction.

In the figures, each reference numeral 1, 2, 3, 4 denotes a cylinder of a 4-cylinder engine (hereinafter simply called a cylinder). Inside each of these cylinders 1, 2, 3 and 4, there is disposed a piston 5, 6, 7, 8 which reciprocates in an axial direction of the respective cylinders. The reciprocating movements of these pistons 5, 6, 7 and 8 are converted into rotary movements by crank mechanisms 9, 10, 11 and 12 for transmission to a crankshaft 13. On an upper portion (cylinder head) of each of the cylinders 1, 2, 3 and 4, there are provided two valve seats 14, 15, 16 and 17, respectively. An intake valve 18, 19, 20, 21 is disposed in each of the valve seats 14, 15, 16 and 17. The intake valves 18, 19, 20 and 21 are arranged to be subject to rotational driving of intake-side cams 26, 27, 28 and 29, respectively, through an apparatus for adjusting a valve lift (hereinafter called a variable valve lifting, VVL, apparatus) 22, 23, 24, 25. Intake-side cams 26, 27, 28 and 29 are disposed on an intake-side camshaft 30. The intake-side camshaft 30 is rotatable in a direction as shown in FIG. 25 by an arrow B by a rotational driving force to be transmitted by a drive transmission member 32 such as a pulley 31, a timing belt, or the like, as well as a pulley 33.

Here, since the intake-side cams 26, 27, 28 and 29 have all the similar construction, an explanation will now be made about the intake-side cam 26 as a typical example. The intake-side cam 26 is made up, as shown in FIG. 26, of a base circle section 26*a* of a true circle in cross section, a lift curve section 26*b* which is raised from this base circle section 26*a*, and ramp sections 26*c* and 26*d* which smoothly connect the base circle section 26*a* and the lift cure section 26*b* together. This arrangement is the same as that of the remaining intake-side cams 27, 28 and 29.

As shown in FIG. 25, the lift curve section 27*b* of the intake-side cam 27 and the lift curve section 28*b* of the intake-side cam 28 are disposed at an offset of about ±90° on the periphery of the intake-side camshaft 30 relative to the lift curve section 26*b* of the intake-side cam 26. The lift curve section 29*b* of the remaining intake-side cam 29 is disposed at an offset of about 180° on the periphery of the intake-side camshaft 30 relative to the lift curve section 26*b* of the intake-side cam 26.

Since the above VVL apparatuses 22, 23, 24 and 25 have all the similar constructions, an explanation will now be made about the VVL apparatus 22 as a typical example. As shown in FIGS. 27 and 28, the VVL apparatus 22 is roughly made up of: a tappet casing 34 having on an upper portion thereof a cam contact portion 34*a* which comes into contact or abutment with a cam surface of the intake-side cam 26; and a hydraulic cylinder (not illustrated) which is disposed inside the tappet casing 34 and which switches between a high lift mode in which a tappet axial length is extended and a low lift mode in which the tappet axial length is contracted. This arrangement is disclosed in German Patent Publication DT1958627. The lower portion of this VVL apparatus 22 is in contact or abutment with an upper portion of a valve stem 35. On a lower portion of this valve stem 35 there is provided the above-described intake valve 18. Between this valve stem 35 and the cylinder 1 there is disposed a valve spring 36 which urges the valve stem 35 axially upward to urge the intake valve 18 against the valve seat 14, whereby the intake valve 18 is brought into a closed state.

An explanation will now be made about the operation of the VVL apparatus 22.

First, right after starting the engine, since the hydraulic pressure to be supplied from an oil pump (not illustrated) to the VVL apparatus 22 is not high enough, the hydraulic cylinder (not illustrated) inside the VVL apparatus 22 has not extended yet, whereby a setting is made to the low lift mode. In the low lift mode, the intake-side cam 26 rotates in the direction of an arrow B. As shown in FIGS. 27A and 27B, the cam contact surface 34*a* of the tappet casing 34 comes into contact with the intake-side cam 26 from the base circle section 26*a* through the ramp section 26*c* toward the lift curve section 26*b*. However, since the axially downward displacement of the cam contact portion 34*a* is still small, the tappet casing 34 and the valve stem 35 do not move axially downward yet. As a result of further rotation of the intake-side cam 26 and, as shown in FIGS. 27C through 27E, when the cam contact portion 34*a* of the tappet casing 34 proceeds to come into contact with the ramp section 26*c* toward the central portion (nose) of the lift curve section 26*b*, the axially downward displacement of the cam contact portion 34*a* increases. Therefore, the tappet casing 34 and the valve stem 35 are pushed downward against the urging force of a helical (or coiled) spring 36. As a consequence, the intake valve 18 is also pushed axially downward relative to the valve seat 14 to attain the low lift state. The valve lift amount at this time gradually increases, as shown in FIG. 27H, from the stage corresponding to FIG. 27C (valve open) and becomes maximum at the stage corresponding to FIG. 27D. As a result of further rotation of the intake-side cam 26 and, as shown in FIG. 27E, once the cam contact portion 34*a* of the tappet casing 34 comes into contact, through the central portion of the lift curve section 26*b*, with the ramp section 26*d*, the axially downward displacement of the cam contact portion 34*a* moves in the direction of decreasing. Therefore, the tappet casing 34 and the valve stem 35 are lifted by the urging force of the helical spring 36 while following the cam profile of the intake-side cam 26. As a result, the intake valve 18 is also forced against the valve seat 14, whereby the lifted state is finished (valve closed). The valve lift amount at this time starts to decrease, as shown in FIG. 27H, from the stage corresponding to FIG. 27D and becomes zero at the stage corresponding to FIG. 27E (valve closed). The finishing of the lifted state continues also during the process, as shown in FIGS. 27F and 27G, in which the cam contact portion 34*a* of the tappet casing 34 contacts the ramp section 26*d* toward the base circle section 26*a*.

In this kind of low lift mode, since the hydraulic pressure inside the hydraulic cylinder is low at the time of low-speed rotation of the engine, the cylinder length corresponding to the tappet axial length is shortened to thereby set the valve lift amount to the low lift. As a result, the flow speed of air-fuel mixture can be increased to improve the combustion efficiency.

At the time of ordinary driving of the engine, the hydraulic pressure to be supplied from the oil pump (not illustrated) to the VVL apparatus 22 has already been sufficiently high. The hydraulic cylinder (not illustrated) inside the VVL apparatus 22 is thus extended to thereby set the mode to a high lift mode. In the high lift mode, the intake-side cam 26 rotates in the direction of the arrow B. As shown in FIG. 28A, the cam contact portion 34*a* of the tappet casing 34 proceeds to contact the intake-side cam 26 from the base circle section 26*a* toward the ramp section 26*c*. However, since the axially downward displacement of the cam contact portion 34*a* is still small, the tappet casing 34 and the valve stem 35 do not move axially downward. As a result of further rotation of the intake-side cam 26 and, as shown in FIGS. 28B through 28D, when the cam contact portion 34*a* of the tappet casing 34 contacts the intake-side cam 26 from the base circle section 26*a* through the ramp section 26*c* toward the lift curve section 26*b*, the axially downward displacement of the cam contact portion 34*a* increases. Therefore, the tappet casing 34 and the valve stem 35 are gradually pushed axially downward against the urging force of the helical spring 36. As a result, the intake valve 18 is also pushed axially downward relative to the valve seat 14 to thereby attain a high lift state. The valve lift amount at this time gradually increases, as shown in FIG. 28H, from the stage corresponding to FIG. 28A (valve open) and attains a maximum value at the stage corresponding to FIG. 28D. As a result of further rotation of the intake-side cam 26 and, as shown in FIGS. 28E through 28G, when the cam contact portion 34*a* of the tappet casing 34 proceeds to contact the central portion of the lift curve section 26*b* toward the ramp section 26*d*, the axially downward displacement of the cam contact portion 34*a* moves in the direction of decreasing. Therefore, the tappet casing 34 and the valve stem 35 are lifted by the urging force of the helical spring 36 while following the cam profile of the intake-side cam 26. As a consequence, the intake valve 18 is also urged against the valve seat 14 to thereby finish the lifted state (valve closed). The valve lift amount at this time starts, as shown in FIG. 28H, to decrease at the stage corresponding to FIG. 28D and becomes zero at the stage corresponding to FIG. 27G (valve closed).

In this kind of high lift mode, by taking advantage of the fact that the drain following characteristic of the hydraulic cylinder at a high-speed rotation of the engine does not catch up, the cylinder length corresponding to the tappet axial length is maintained and the valve lift amount is maintained to a high lift amount. In this manner, a lower specific fuel consumption and a higher engine output can be attained by improving the suction efficiency.

In this kind of VVL apparatus 22, in the high lift mode, due to a clearance (not illustrated) which is provided between the intake-side cam 26 and the cam contact portion 34*a* of the tappet casing 34 to take into account the thermal expansion or the like, the intake-side cam 26 and the tappet casing 34 come into collision with each other as a result of the rotation of the intake-side cam 26 having the high lift profile at the time of the following: i.e., at the time when, as shown in FIG. 28A, the cam contact portion 34*a* of the tappet casing 34 comes into contact with the intake-side cam 26 after going through the base circle section 26*a* and the ramp section 26*c* toward the lift curve section 26*b*; and at the time when s shown in FIG. 28G, the contact portion 34*a* of the tappet casing 34 comes into contact with the suction-side cam 26 after going through the lift curve section 26*b* and the ramp section 26*d* toward the base circle section 26*a*. It is, however, possible to absorb and restrict the collision noises at the above-described ramp section 26*c* or 26*d*.

In the above-described VVL apparatus 22, however, the intake-side cam 26 having the high lift profile is used also in the low lift mode. Therefore, while the collision noises attributable to the above-described clearance (not illustrated) can be restricted or kept under control, it is difficult to effectively restrict such collision noises as described hereinbelow. Namely, in the low lift mode, the axial length of the tappet casing 34 is reduced. Therefore, the time when the ramp sections 26*c* and 26*d* of the intake-side cam 26 come into contact with the cam contact portion 34*a* of the tappet casing 34 falls, as shown in FIGS. 27B and 27F, under such a period of reduced axial length of the tappet as will not substantially contribute to the opening and closing of the intake valve 18. Therefore, the ramp sections 26*c* and 26*d* cannot serve the function of smoothly connecting the base circle section 26*a* and the lift curve section 26*b* together. As a result, there was a problem in that the following collision noises cannot be effectively restricted. The noises in question are: collision noises which occur, at the beginning of valve lifting, between the tappet and the valve stem as a result of rapid lifting of the intake valve 18 at the time of contact of the ramp section 26*c*, right after the contact thereof, with the former part of the lift curve section 26*b*; and collision noises which occur, at the end of valve lifting, between the intake valve 18 and the valve seat as a result of rapid forcing of the intake valve against the valve seat at the time of contact of the ramp section 26*d*, right before the contact thereof, with the latter half of the lift curve section 26*b*.

In addition, in the above-described VVL apparatus 22, there is employed no construction of locking the extension and contraction of the hydraulic cylinder at a specific point. Therefore, the valve lift amount (i.e., accuracy) depends on the amount of oil leak from the hydraulic cylinder, the rotational frequency of the engine (i.e., the speed of forcing the piston into the cylinder), or the like. As a result, it is considered difficult to set the valve lift amount to a specific value.

As a possible solution to this problem, Unexamined International Patent Publication (KOHYO KOHO) No. 507242/1998 and Japanese Published Unexamined Patent Application (KOKAI KOHO) No. 141030/1998 disclose VVL apparatuses in which a specific valve lift amount can be set. These VVL apparatuses are each substantially made up of: a plurality of cams provided on a camshaft rotatably driven by a crankshaft of an engine; an inner tappet which reciprocates in an axial direction of a valve stem to follow a cam profile of a rotary cam, out of a plurality of cams, of a low-lift cam which contributes to the opening and closing of the valve in a low rotational speed region; an outer tappet which is provided on an outside of the inner tappet and which reciprocates in the axial direction of the valve stem to follow a cam profile of a rotary cam, out of the plurality of cams, of a high lift cam which contributes to the opening and closing of the valve in a high rotational speed region; and a moving member which is disposed inside the inner tappet so as to be movable in a radial direction of the inner tappet. This moving member moves in the following manner. Namely, in a high lift mode, it moves radially outward by the hydraulic pressure supplied to the central portion of the inner tappet so as to be engaged with a recessed portion on an inner circumference of the outer tappet, whereby both the tappets are integrated together. In a low lift mode, on the other hand, it is returned radially inward of the inner tappet by an urging means such as a spring or the like in a state of low hydraulic pressure so that the moving member is disengaged from the recessed portion of the outer tappet, whereby both the tappets are separated from each other.

In this kind of VVL apparatus, two kinds of cams, i.e., a high lift cam and a low lift cam, are disposed on a single camshaft in order to open and close a single valve. Therefore, this apparatus can restrict the generation of peculiar collision noises which are generated in the arrangement utilizing a single high lift cam in the low lift mode as represented by the above-described German Patent Publication DT19658627.

In the conventional VVL apparatus, however, it is necessary to provide two kinds of cams, i.e., a high lift cam and a low lift cam, resulting in another problem in that the number of parts increases with a consequent high cost and increased weight.

The present invention has been made to solve the above-described problems and has an object of providing a VVL apparatus in which, even in a low lift mode, the collision noises can appropriately be absorbed to thereby secure a silence at the time of low rotational frequency of the engine and in which the number of parts such as cams or the like can be reduced to attain a lower cost and smaller weight of the VVL apparatus.

SUMMARY OF THE INVENTION

In order to attain the above and other objects, the present invention is an apparatus for adjusting a valve lift, comprising: a tappet casing having a cam contact portion which comes into contact with a cam provided on a camshaft rotatably driven by a crankshaft of an internal combustion engine; lift mode switching means for selectively switching between a high lift mode in which an amount of displacement of one of an intake valve and an exhaust valve of a cylinder corresponding to the tappet casing is equal to an amount of displacement of the cam contact portion of the tappet box, and a low lift mode in which the amount of displacement of the other of the intake valve and the exhaust valve relative to the amount of displacement of said one of the intake valve and the exhaust valve decreases relative to the amount of displacement of the cam contact portion; restricting means for holding the lift mode switching means to the high lift mode; and urging means for urging in a direction in which the amount of displacement of the valve by the lift mode switching means increases in the low lift mode.

Preferably, the apparatus has the following arrangements.

Namely, the cam to contact the cam contact portion of the tappet casing has a cam profile for a high lift cam which is suitable for operating conditions of one or both of above intermediate speed and above an intermediate load of the internal combustion engine.

The lift mode switching means is set such that, under operating conditions of one or both of below intermediate speed and below intermediate load of the internal combustion engine, the amount of displacement of one of the intake valve and the exhaust valve decreases relative to an amount of axial displacement of the cam contact portion of the tappet casing.

The lift mode switching means comprises: an outer tube which is disposed inside the tappet casing; and an inner tube which comes into contact with a valve stem of one of the intake valve and the exhaust valve.

The inner tube is disposed inside the outer tube so as to be relatively slidable in an axial direction of the outer tube and be relatively rotatable in a circumferential direction of the outer tube.

The inner tube has one of a projection and a recess on a periphery thereof, and the outer tube has the other of the projection and the recess which comes into engagement with said one of the projection and the recess to thereby restrict an axial movement and a peripheral movement of the outer tube.

The projection is a pin having a substantially circular cross section, and the recess is a groove having a shape engageable with the pin.

The recess has a substantially arcuate shape which is capable of gradually converting the movement of one of the inner tube and the outer tube having the projection from the axial sliding to the peripheral rotation.

The recess in the lift mode switching means is an arcuate groove of secondary curve so constructed and arranged that, when one of the intake valve and the exhaust valve operates in a direction of reducing the amount of displacement of the valve, the closer to a position of maximum decrease in the amount of displacement of the valve, the more rapid increase in an amount of circumferential displacement of the inner tube relative to the outer tube.

The outer tube is urged by urging means to urge the inner tube in a direction of increasing the amount of displacement of one of the intake valve and the exhaust valve.

The outer tube is urged by urging means to urge the cylinder in a direction of increasing the amount of displacement of one of the intake valve and the exhaust valve.

The urging means is disposed between a head portion of the outer tube and a head portion of the inner tube.

An urging force of the urging means is set, at a point of time when the amount of displacement of one of the intake valve and the exhaust valve becomes minimum relative to the amount of displacement of the contact portion of the tappet casing, so as to become larger than an urging force of a valve spring for closing the other of the intake valve and the exhaust valve.

The lift mode switching means is constituted into an element which is contained inside the tappet casing and which is separate from the tappet casing.

The restricting means mechanically engage the outer tube and the inner tube when, under one of operating conditions of above an intermediate speed and above an intermediate load of the internal combustion engine, the amount of displacement of one of the intake valve and the exhaust valve is equal to the amount of displacement of the cam contact portion of the tappet and when a state thereof is maintained.

The restricting means has an oil passage so constructed and arranged that the outer tube and the inner tube of the lift mode switching means are restricted by a supply of hydraulic pressure and that the restriction is released by lowering in the hydraulic pressure or by stopping of supply of the hydraulic pressure.

The apparatus further comprises a mechanical urging means for urging in a direction of releasing the restriction of the lift mode switching means.

The outer tube of the lift mode switching means has a communicating hole which communicates a space formed between the outer tube and the inner tube with an atmosphere.

The tappet casing is contained inside a containing hole beside the internal combustion engine so as to be axially slidable and circumferentially rotatable.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

An explanation will now be made about preferred embodiments of the present invention.

EXAMPLE 1

Figure 1:
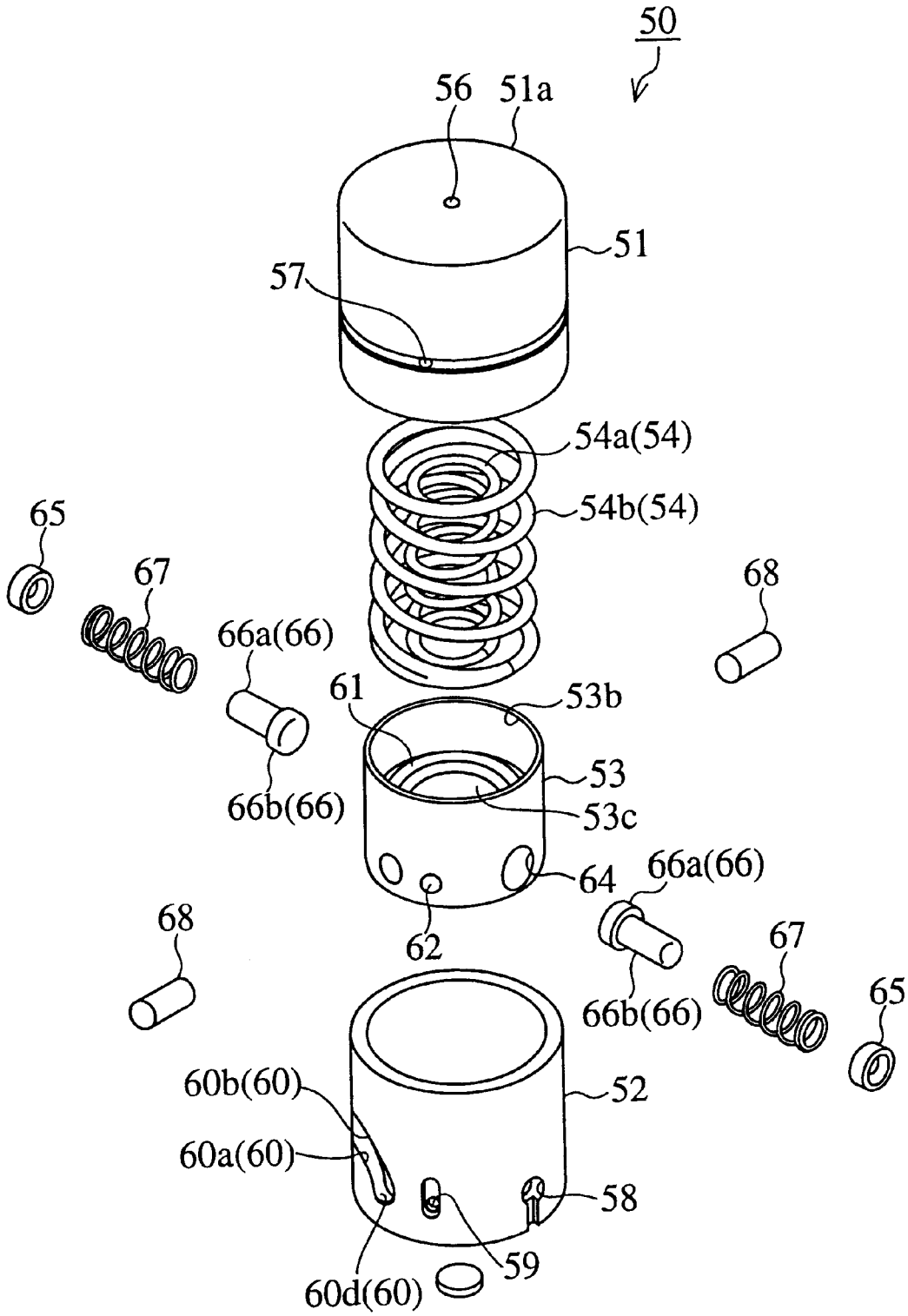
FIG. 1 is an exploded perspective view of a VVL apparatus according to Example 1 of the present invention.
Figure 2:
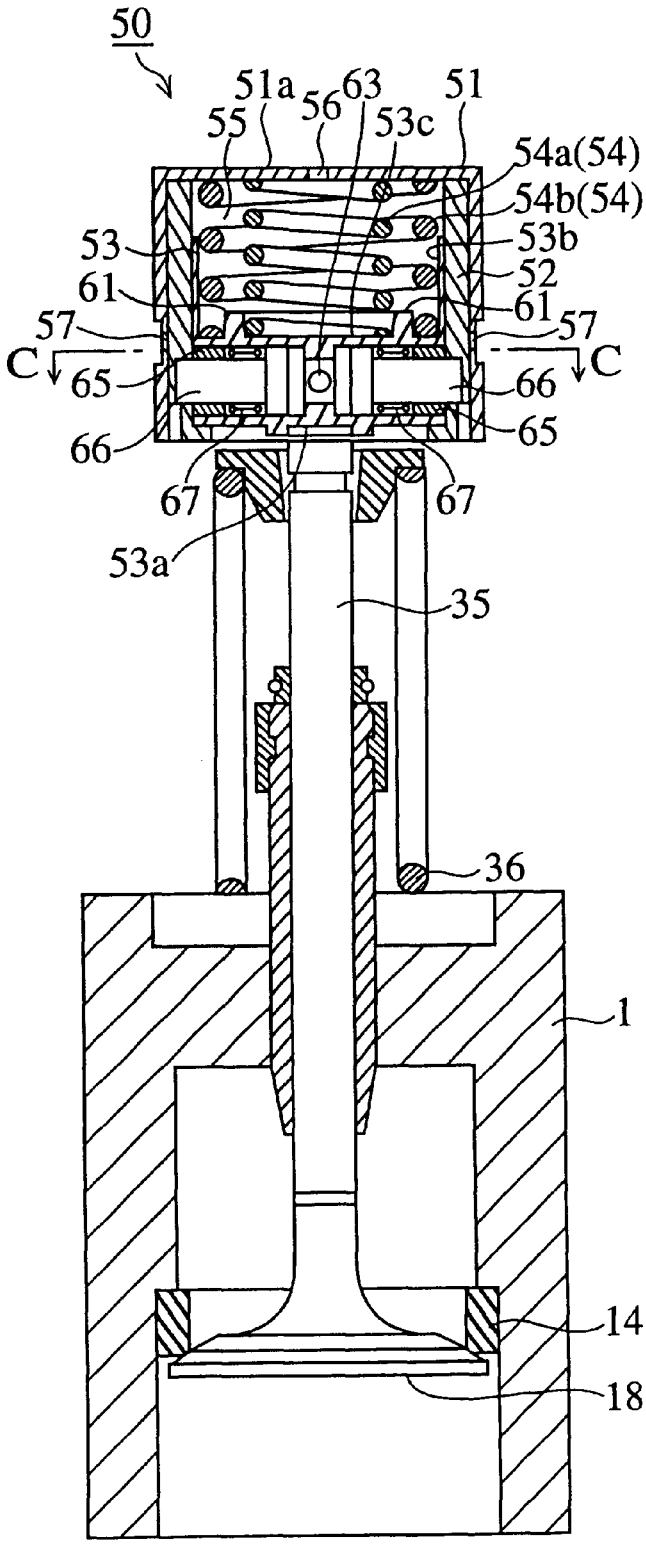
FIG. 2 is a sectional view showing an inner construction of the VVL apparatus in FIG. 1 in a high lift mode.
Figure 3:
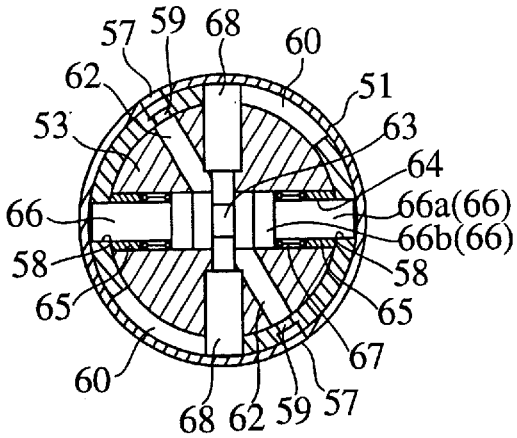
FIG. 3 is a sectional view taken along the line C—C in FIG. 2.
Figure 4:
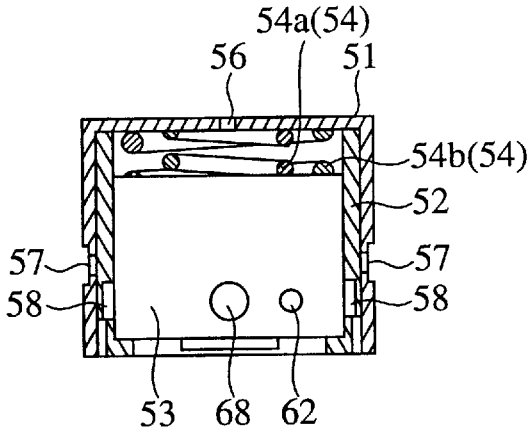
FIG. 4 is a partial sectional view showing a peripheral portion of an inner tube of the VVL apparatus in FIG. 1.
Figure 5:
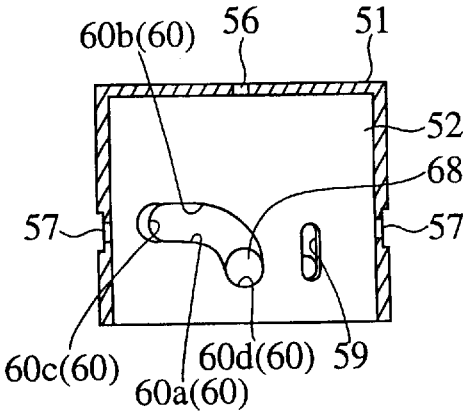
FIG. 5 is a partial sectional view showing a peripheral portion of an outer tube of the VVL apparatus in FIG. 1.
Figure 6:
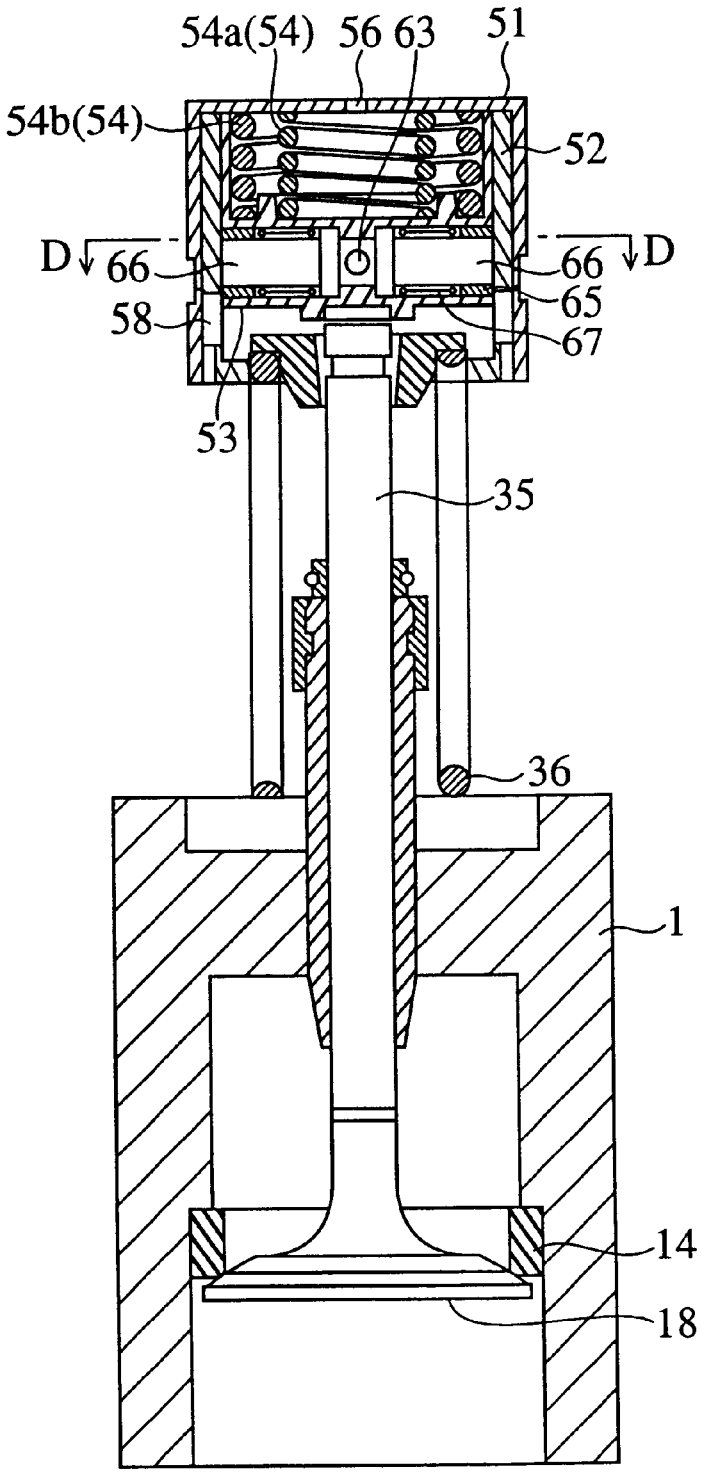
FIG. 6 is a sectional view showing an inner construction of the VVL apparatus in FIG. 1 in a low lift mode.
Figure 7:
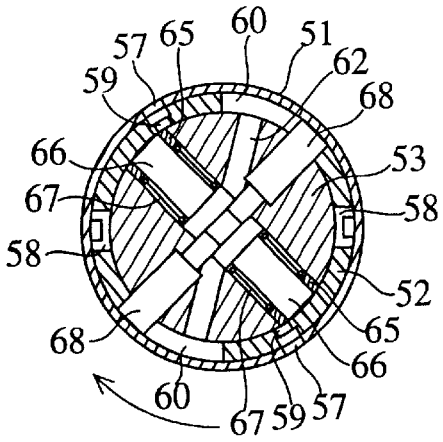
FIG. 7 is a sectional view taken along the line D—D in FIG. 6.
Figure 8:
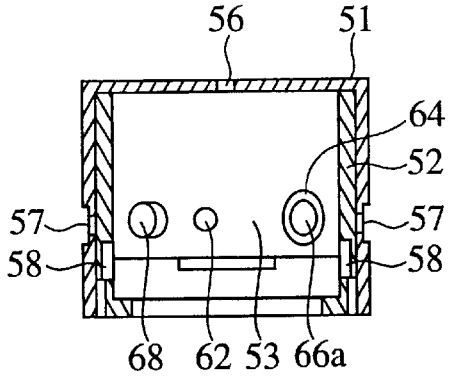
FIG. 8 is a partial sectional view showing a peripheral portion of the inner tube of the VVL apparatus in FIG. 6.
Figure 9:
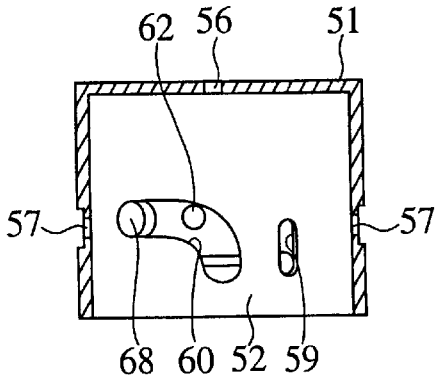
FIG. 9 is a partial sectional view showing a peripheral portion of an outer tube of the VVL apparatus in FIG. 6.
Figure 10A:
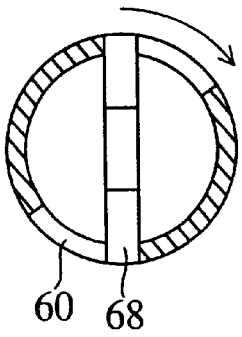
FIGS. 10A through 10C are schematic sectional views to explain the valve opening operation of lift mode switching means which functions as a mechanism for damping the shock forces in the VVL apparatus in FIG. 6.
Figure 10B:
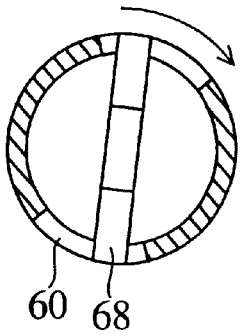
Figure 10C:
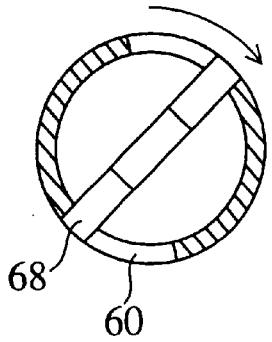
Figure 11A:
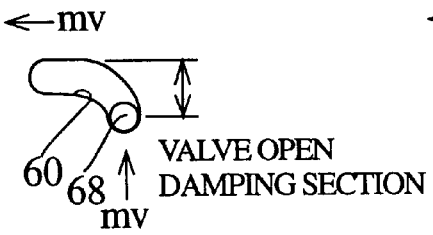
FIGS. 11A through 11C are schematic front views to explain the valve opening operation of the lift mode switching means which functions as a mechanism for damping the shock forces in the VVL apparatus in FIG. 6.
Figure 11B:
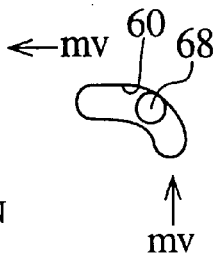
Figure 11C:
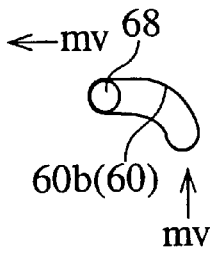
Figure 12A:
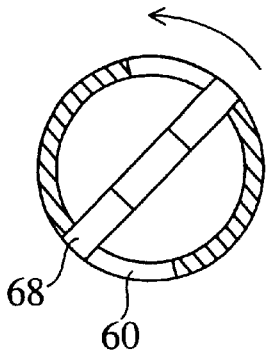
FIGS. 12A through 12C are schematic sectional views to explain the valve closing operation of the lift mode switching means which functions as a mechanism for dampening the shock forces in the VVL apparatus in FIG. 6.
Figure 12B:
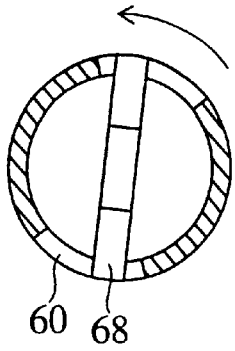
Figure 12C:
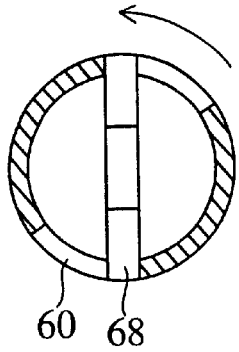
Figure 13A:
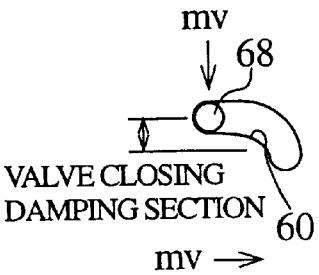
FIGS. 13A through 13C are schematic front views to explain the valve closing operation of the lift mode switching means which functions as a mechanism for dampening the shock forces in the VVL apparatus in FIG. 6.
Figure 13B:
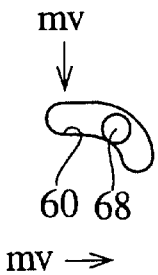
Figure 13C:
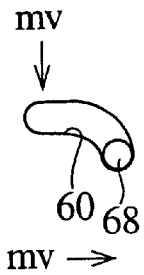
Figures 14A, 14B, 14C, 14D, 14E, 14F, 14G, 14H:
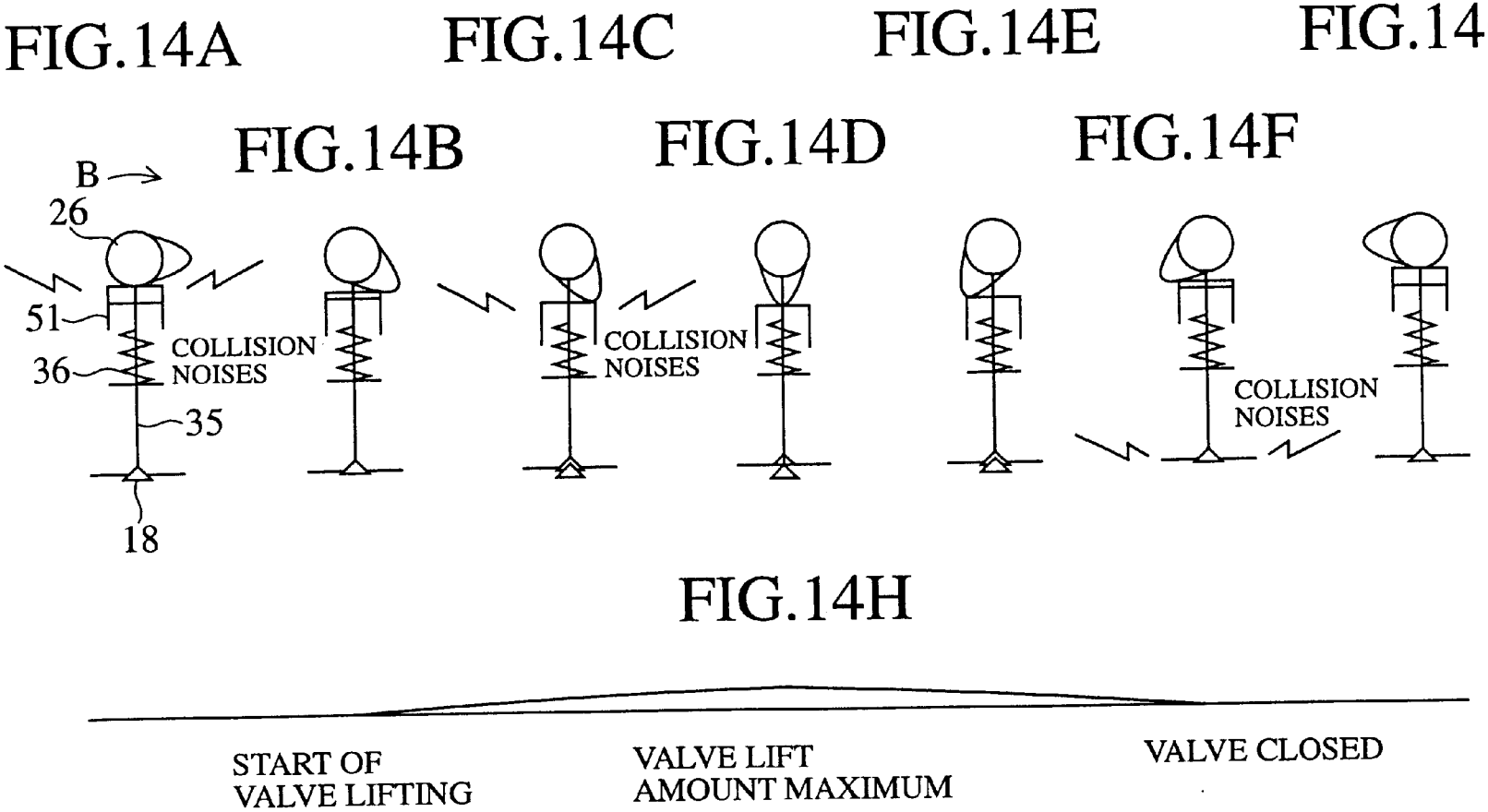
FIGS. 14A through 14G are schematic sectional views to explain the valve opening operation and the valve closing operation in the low lift mode of the VVL apparatus in FIG. 6.
FIG. 14H is a graph continuously showing the change in the valve lift amount.
Figures 15A, 15B, 15C, 15D, 15E, 15F, 15G, 15H:
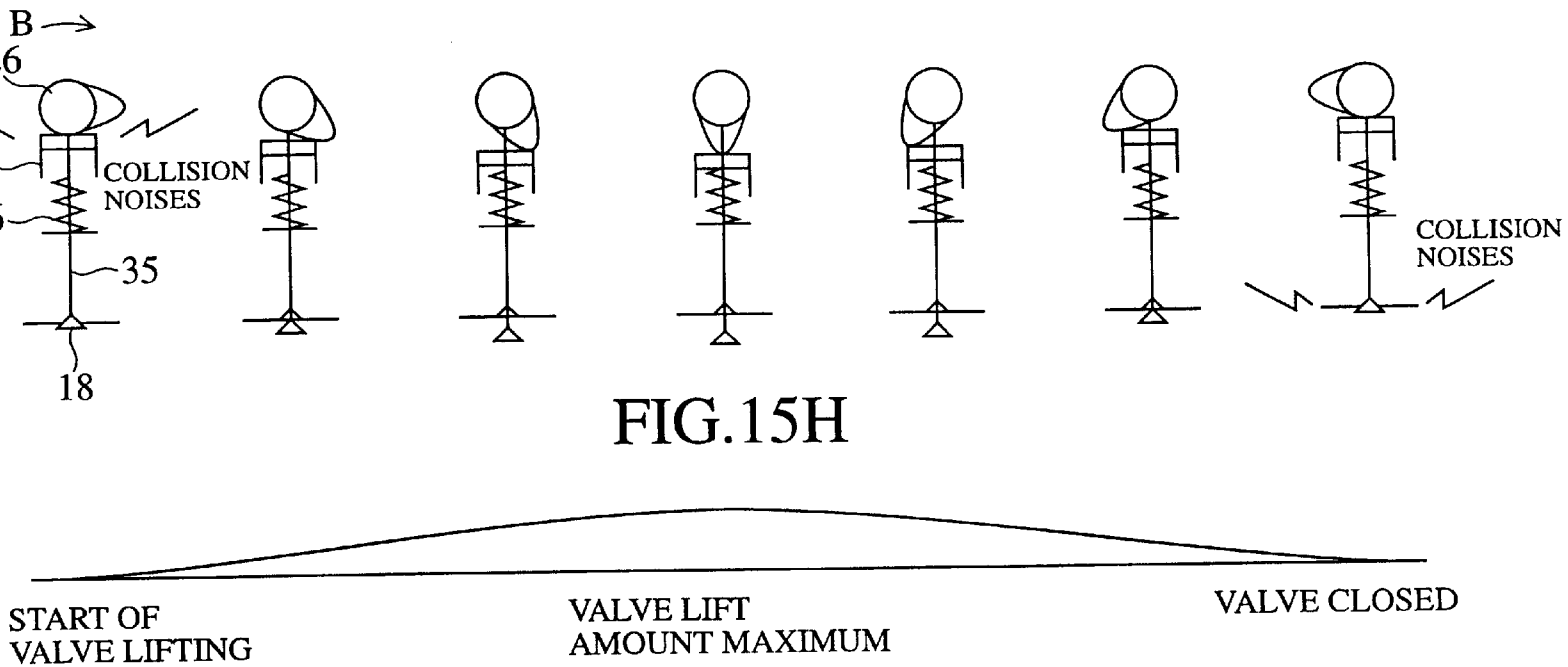
FIGS. 15A through 15G are schematic sectional views to explain the valve opening operation and the valve closing operation in the high lift mode of the VVL apparatus in FIG. 1.
FIG. 15H is a graph continuously showing the change in the valve lift amount.

FIG. 1 is an exploded perspective view of a VVL apparatus according to Example 1 of the present invention. FIG. 2 is a sectional view showing an inner construction of the VVL apparatus in FIG. 1 in a high lift mode. FIG. 3 is a sectional view taken along the line C—C in FIG. 2. FIG. 4 is a partial sectional view showing a peripheral portion of an inner tube of the VVL apparatus in FIG. 1. FIG. 5 is a partial sectional view showing a peripheral portion of an outer tube of the VVL apparatus in FIG. 1. FIG. 6 is a sectional view showing an inner construction of the VVL apparatus in FIG. 1 in a low lift mode. FIG. 7 is a sectional view taken along the line D—D in FIG. 6. FIG. 8 is a partial sectional view showing a peripheral portion of the inner tube of the VVL apparatus in FIG. 6. FIG. 9 is a partial sectional view showing a peripheral portion of an outer tube of the VVL apparatus in FIG. 6. FIGS. 10A through 10C are schematic sectional views to explain the valve opening operation of lift mode switching means which functions as a mechanism for damping the shock forces in the VVL apparatus in FIG. 6. FIGS. 11A through 11C are schematic front views to explain the valve opening operation of the lift mode switching means which functions as a mechanism for damping the shock forces in the VVL apparatus in FIG. 6. FIGS. 12A through 12C are schematic sectional views to explain the valve closing operation of the lift mode switching means which functions as a mechanism for dampening the shock forces in the VVL apparatus in FIG. 6. FIGS. 13A through 13C are schematic front views to explain the valve closing operation of the lift mode switching means which functions as a mechanism for dampening the shock forces in the VVL apparatus in FIG. 6. FIGS. 14A through 14G are schematic sectional views to explain the valve opening operation and the valve closing operation in the low lift mode of the VVL apparatus in FIG. 6, and FIG. 14H is a graph continuously showing the change in the valve lift amount. FIGS. 15A through 15G are schematic sectional views to explain the valve opening operation and the valve closing operation in the high lift mode of the VVL apparatus in FIG. 1, and FIG. 15H is a graph continuously showing the change in the valve lift amount.

The intake-side VVL apparatus and the exhaust-side VVL apparatus have the constructions and operations which are similar to each other. Therefore, an explanation will be made about the intake-side VVL apparatus only and that of the exhaust-side VVL apparatus is omitted. In addition, the following explanation is based on the assumption that the cylinder is disposed to extend in a vertical direction. Further, among the constituting elements in the Example 1, the element in common with the conventional VVL apparatus has attached thereto the same reference numerals, and the explanation thereabout is omitted.

The VVL apparatus 50 according to Example 1 is roughly made up of: a substantially cylindrical tappet casing 51 having on an upper end surface thereof a cam contact portion 51*a* which comes into contact with an intake-side cam (not illustrated) having a high lift cam profile suitable for operating conditions of one or both of above an intermediate speed and above intermediate load of the engine; an outer tube (or an outer cylindrical body) 52 which is coaxially disposed inside the tappet casing 51 and which has on an upper portion thereof an opening 52*a* (this outer tube being defined as a lift mode switching means); an inner tube (or an inner cylindrical body) which is coaxially disposed inside the outer tube 52 so as to be slidable in the axial direction and be rotatable in the circumferential direction and which has on a lower end portion thereof a valve stem contact portion 53*a* (this inner tube being defined as a lift mode switching means); and a helical spring 54 which is disposed between the inner tube 53 and the tappet casing 51 so as to constantly urge the inner tube 53 in a direction of increasing the amount of axial displacement of the intake valve, i.e., in a direction of opening the intake valve 18 (this helical spring being defined as an urging means).

In the center of the contact portion 51*a* of the tappet casing 51, there is provided a communicating hole 56 which brings the inner space 55 formed between the outer tube 52 and the inner tube 53 into communication with an atmosphere. On a peripheral portion of the tappet casing 51, there are provided a pair of hydraulic oil pressure (simply called hydraulic pressure) supply and discharge holes 57 at positions of point-symmetry relative to an axial line of the tappet casing 51. These hydraulic pressure supply and discharge holes 57 function to supply and discharge the hydraulic pressure to and from a variable valve timing adjusting apparatus (not illustrated) through an oil passages (not illustrated) which is formed inside a cylinder head (not illustrated) of the cylinder 1. The tappet casing 51 having the above-described construction is contained inside a containing hole (not illustrated) which is provided in the cylinder head (not illustrated) of the cylinder 1 so as to be slidable in the axial direction of the tappet casing 51 and be rotatable in the circumferential direction of the tappet box 51.

On a peripheral portion of the outer tube 52, there are provided a pair of fitting holes 58 (defined as restricting means) at positions of point-symmetry relative to an axial line of the outer tube 52. On a peripheral portion of the outer tube 52, there are also provided a pair of communicating holes 59 which are disposed at positions of point-symmetry relative to the axial line of the outer tube 52 in a manner to extend in the axial direction of the outer tube 52 so as to be in communication with the hydraulic pressure supply and discharge holes 57 in the tappet casing 51. Further, as shown in FIGS. 5, 9 and others, there are formed in the peripheral portion of the outer tube 52 a pair of substantially arcuate ramp grooves 60 (defined as recessed portions) each having an inner arcuate portion 60*a*, an outer arcuate portion 60*b*, an upper stop position 60*c*, and a lower stop position 60*d*.

An upper portion of the inner tube 53 has formed therein an opening 53*b*. On an inner bottom 53*c* of this opening 53*b*, there is formed an annular projected portion 61 to separate, out of the urging member 54, a helical (or coiled) spring 54*a* from a helical spring 54*b*. Between a valve stem contact portion 53*a* and an inner bottom portion 53*c* of the inner tube 53, there are formed oil supply and discharge passages 62 which can be simultaneously communicated with the pair of communication holes 59 of the outer tube 52. The oil supply and discharge passages 62 are in communication with an oil chamber 63 in the central portion of the inner cylinder 53. This oil chamber 63 is also in communication with internal cylinders 64 which penetrate or pass through the peripheral portion of the inner tube 53. A pair of sleeves 65 are press-fit into the internal cylinders 64 in the neighborhood of the peripheral portion of the inner tube 53. A pair of lock pins 66 (defined as restricting means) which can be fit into the fitting holes 58 in the outer tube 52 are disposed inside the sleeve 65 so as to be slidable in the axial direction of the internal cylinders 64. Each of the lock pins 66 is substantially made up of a small-diameter portion 66*a* having an outer diameter corresponding to the inner diameter of the sleeve 65, and a large-diameter portion 66*b* having an outer diameter corresponding to the inner diameter of the inner cylinder 64. A helical spring 67 for constantly urging the lock pin 66 toward the oil chamber 63 is respectively disposed between an axial end surface of the large-diameter portion 66*b* of each of the lock pins 66 and the axial end surface of each of the sleeves 65. A pair of pins (defined as projected portions) 68 which project radially outward and which come into engagement with the ramp grooves 60 of the outer tube 52 are disposed on the peripheral portion of the inner tube 53. Each of the pins 68 has a substantially circular cross section, and each of the ramp grooves 60 has a shape to enable the pin 68 to engage therewith and a size enough for the pin 68 to move therein.

The helical spring 54 is made up of two strings of helical springs 54*a* and 54*b*. It is so arranged that, at the point of time when the amount of axial displacement of the intake valve 18 (a valve open amount) becomes minimum relative to the amount of axial displacement of the cam contact portion 51*a* of the tappet casing 51, i.e., at the time right before valve closing, the urging force of the helical spring 54 becomes larger than the urging force of the valve spring 36. According to this arrangement, the shocks between the valve and the valve seat become weaker and the collision noises can be restricted.

The ramp groove 60 is an arcuate groove in a curve of secondary degree such that, when the intake valve 18 operates in a direction of reducing the amount of axial displacement, the closer to the position of maximum reduction in the amount of axial displacement of the intake valve 18, the more rapid increase in the amount of relative circumferential displacement of the inner tube 53 relative to the outer tube 52. It means that the inner arcuate portion 60*a* and the outer arcuate portion 60*b* of the ramp groove 60 have a component in the axial direction and a component of the circumferential direction of the outer tube 52. It is preferable that a profile of each of the arcuate portions 60*a*, 60*b* is smoothly slidable therealong.

An explanation will now be made about the operation of the VVL apparatus.

First, under operating conditions of one or both of below an intermediate speed and an intermediate load of the engine, the hydraulic pressure to be supplied from an oil pump (not illustrated) to the VVL apparatus 50 is not high, or else, the oil supply is arbitrarily stopped. Therefore, the hydraulic pressure in the oil chamber 63 of the inner tube 53 of the VVL apparatus 50 cannot resist the urging force of the helical spring 67. As a result, the lock pins 66 move, as shown in FIG. 6, radially inward of the inner tube 53 by the urging force of the helical spring 67. At this time, the small-diameter portion 66*a* of each of the lock pins 66 gets out of engagement with the fitting hole 58 of the outer tube 52, whereby the restriction between the outer tube 52 and the inner tube 53 is released (defined as a low lift mode). Here, the inner tube 53 is urged by the urging force of the valve spring 36 toward such inside of the cam contact portion 51*a* of the tappet casing 51 as is exposed from the opening portion 52*a* of the outer tube 52. The cam contact portion 51*a* of the tappet casing 51 is kept urged toward the intake-side cam (not illustrated) by the urging force of the helical spring 54.

In this low lift mode, as shown in FIG. 14A, the intake-side cam 26 rotates in the direction of the arrow B. The cam contact portion 51*a* of the tappet casing 51 comes into contact with the base circle section 26*a* toward the ramp section 26*c*. At this time, the collision noises to be generated by a clearance (not illustrated) provided between the intake-side cam 26 and the cam contact portion 51*a* of the tappet casing 51 to take into account the thermal expansion or the like can be restricted by the ramp section 26*c* of the intake-side cam 26.

Then, as a result of further rotation of the intake-side cam 26, as shown in FIGS. 14B and 14C, the cam contact portion 51*a* comes into contact with the intake-side cam 26 at the ramp section 26*c* toward the former half portion of the lift curve section 26*b*. At this time, the lift curve section 26*b* of the intake-side cam 26 urges only the tappet casing 51 axially downward against the urging force of the helical spring 54 by an amount of the contracted stroke of the helical spring 54, i.e., by the difference in stroke between the low lift mode and the high lift mode. At this stage, only the tappet casing 51 axially moves and the valve stem 35 and the intake valve 18 do not move. The outer tube 52 moves axially downward together with the tappet casing 51. Now, the pins 68 in the inner tube 53 move, as shown in FIGS. 10A through 10C and 11A through 11C, while keeping in contact with the outer arcuate portion 60*b* in the ramp groove 60 of the outer tube 52. Here, since the inner tube 53 changes the moving direction, right before completion of the movement, from the axial displacement to the circumferential displacement, the shock force of the inner tube 53 itself in the axial direction relative to the outer tube 52 decreases. As a result, the shock can be reduced at the time when the valve stem contact portion 53*a* of the inner tube 53 and the upper end portion of the valve stem 35 come into contact with each other, resulting in an effective restriction of the collision noises. After this contact, the intake valve 18 is opened (defined as valve open).

As a result of further rotation of the intake-side cam 26, as shown in FIGS. 14D through 14G, the cam contact portion 51*a* comes into contact with the latter half portion of the lift curve section 26*b* through the ramp section 26*a* toward the base circle section 26*a*. At this time, the lift curve section 26*b* urges the tappet casing 51 axially downward against the difference between the urging force of the helical spring 54 and the urging force of the valve spring 36. At this time, the pins 68 of the inner cylinder 68 move, as shown in FIGS. 12A through 12C and 13A through 13C, while they keep in contact with the inner arcuate portion 60*a* of the ramp groove 60. Here, since the inner tube 53 changes its direction of movement, right before the completion of the movement, from the axial displacement to the circumferential displacement, the axial displacement of the inner tube 53 itself decreases right before the completion of the movement. In addition, the urging force of the helical spring 54 is set so as to become larger than the urging force of the valve spring 36 at the time when the amount of axial displacement of the intake valve 18 becomes minimum relative to the amount of axial displacement of the cam contact portion 51*a* of the tappet casing 51. Therefore, it is possible to brake the closing movement of the intake valve 18 right before the valve closing. According to this arrangement, the shocks between the intake valve 18 and the valve seat 14 are weakened, resulting in an effective restriction of the collision noises (defined as valve closing).

Under the operating conditions of one or both of above the intermediate speed and above the intermediate load of the engine, the hydraulic pressure to be supplied from the oil pump (not illustrated) to the VVL apparatus 50 has already become high enough. Therefore, the hydraulic pressure supplied through oil control valves (not illustrated) or the like is supplied to the oil chamber 63 through the oil pressure supply and discharge hole 57, the communicating holes 59 in the outer tube 52, and the oil supply and discharge passages 62 in the inner tube 53. Due to this hydraulic pressure, the lock pins 66 inside the inner cylinder 64 move radially outward against the holding force of the helical springs 67, whereby the small-diameter portions 66*a* get fit into the fitting holes 58 in the outer tube 52. As a result, the outer tube 52 and the inner tube 53 are integrated together (defined as high lift mode).

Figures 28A, 28B, 28C, 28D, 28E, 28F, 28G, 28H:
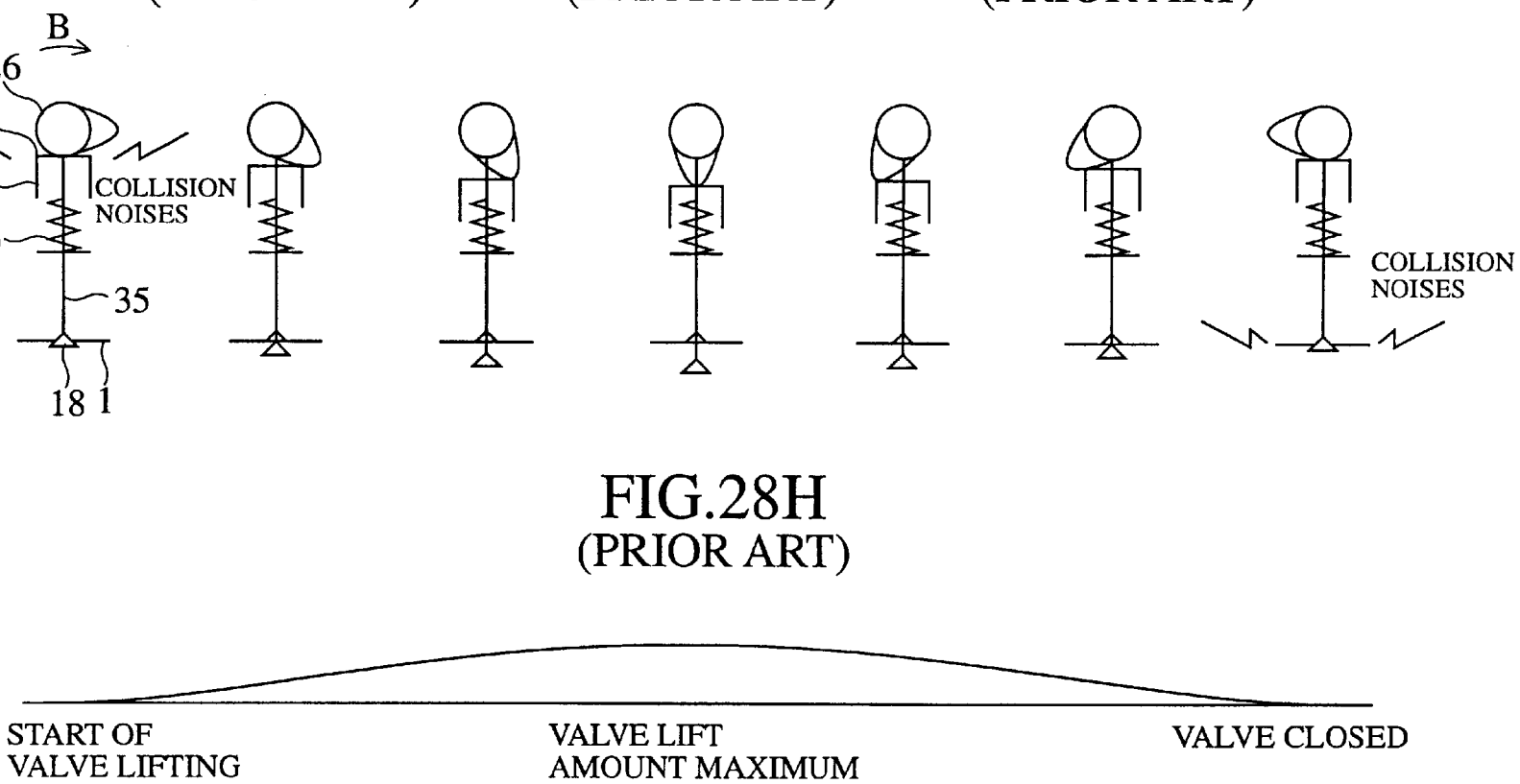
FIG.28A (PRIOR ART)
FIG.28B (PRIOR ART)
FIG.28C (PRIOR ART)
FIG.28D (PRIOR ART)
FIG.28E (PRIOR ART)
FIG.28F (PRIOR ART)
FIG.28G (PRIOR ART)
FIG.28H (PRIOR ART)
FIGS. 28A through 28G are schematic sectional views to show the conventional valve opening movement and valve closing movement of the VVL apparatus shown in FIG. 24 in a high lift mode.
FIG. 28H is a graph continuously showing the change in the valve lift amount.

The valve operation at the time of high lift mode is the same as that in the high lift mode of the conventional VVL apparatus 22 as shown in FIG. 28. Therefore, the explanation thereof is omitted.

As explained herein above, according to Example 1 of the present invention, the lift mode switching means is disposed inside a single tappet casing 51 having a single cam contact portion 51*a* coming into contact with a single cam. It is thus possible to set the high lift mode and the low lift mode with a single cam. Therefore, there is an effect in that, as compared with the conventional apparatus employing two cams, the number of parts can be reduced and the cost can be kept lower. Further, in the high lift mode, a higher engine output can be attained and, in the low lift mode, the specific fuel consumption can be improved.

Further, according to Example 1 of the present invention, the cam 26 coming into contact with the cam contact portion 51*a* of the tappet casing 51 is arranged to have a high lift cam profile which is suitable for operating conditions of one or both of above an intermediate speed and above an intermediate load of the engine. Therefore, there is an effect in that a higher engine output can be attained in the high lift mode.

Furthermore, according to Example 1 of the present invention, the lift mode switching means is set such that, under operating conditions of one or both of below an intermediate speed and below an intermediate load of the engine, the amount of displacement of the intake valve 18 decreases relative to the amount of axial displacement of the cam contact portion 51*a* of the tappet casing 51. Therefore, there is an effect in that the specific fuel consumption in the low lift mode can be improved.

Furthermore, according to Example 1 of the present invention, the lift mode switching means is made up of: an outer tube 52 which is disposed inside the tappet casing 51; and an inner tube 53 which is disposed inside the outer tube 52 so as to be rotatably slidable in the axial direction of the outer tube 52 and which comes into contact with the valve stem 35 of the exhaust valve 18. Therefore, as a result of relative sliding of the outer tube 52 and the inner tube 53 in the axial direction thereof within a predetermined range under predetermined operating conditions, there can be obtained an effect in that the low lift mode and the high lift mode can be selectively switched. In addition, since the lift mode switching means is simplified in construction, there is an effect in that the cost can be reduced.

Further, according to Example 1 of the present invention, the inner tube 53 is constituted so as to be axially slidable relative to the outer tube 52 and be relatively rotatable in the circumferential direction of the outer tube 52. Therefore, the lift mode switching means can be simplified in construction and the cost can be reduced.

Still furthermore, according to Example 1 of the present invention, the inner tube 53 is constituted to have the pins 68 on a peripheral portion thereof, and the outer tube 52 is constituted to have the ramp grooves 60 which come into engagement with the pins 68 of the inner tube 53 to thereby restrict the axial movement and the circumferential movement of the outer tube 52. Therefore, the lift mode switching means can be functioned as a shock absorbing mechanism, whereby the collision noises to be generated at the time of valve opening and valve closing can be effectively restricted.

Furthermore, according to Example 1 of the present invention, there are provided the pins 68 of substantially circular cross section and the ramp groove 60 to be engaged therewith. Therefore, the engagement of both the elements can be made surely, with the result that the reliability of operation and the durability of the parts can be improved.

Further, according to Example 1 of the present invention, the ramp groove 60 is constituted to have a substantially arcuate shape which is capable of gradually converting the movement of the inner tube 53 from the axial siding to the peripheral rotation. Therefore, the shocks in the axial direction at the time of valve opening and valve closing can be effectively restricted by dispersing them in the peripheral direction.

Still furthermore, according to Example 1 of the present invention, the ramp groove 60 of the lift mode switching means is constituted into an arcuate groove of a curve of a secondary degree so constructed and arranged that, when it operates in the direction of reducing the amount of displacement of the intake valve 18, the closer to the position of maximum reduction in the amount of displacement of the intake valve 18, the more rapid increase in the amount of relative circumferential displacement of the inner tube 53 relative to the outer tube 52. Therefore, the shocks in the axial direction at the time of valve opening and valve closing can be dispersed in the circumferential direction, whereby the collision noises can be effectively restricted.

Furthermore, according to Example 1 of the present invention, the outer tube 52 is constituted to be urged by the helical spring 54 in order to urge the inner tube 53 in the direction of increasing the amount of displacement of the intake valve 18. Therefore, by arbitrarily setting the urging force of the helical spring 54, only the tappet casing 51 is axially moved in the low lift mode. Accordingly, there is an effect in that the collision noises to be generated between the tappet and the valve stem can be restricted.

Still furthermore, according to Example 1 of the present invention, since the helical spring 54 is disposed between the head portion of the outer tube 52 and the head portion of the inner tube 53, there is an effect in that the VVL apparatus 50 can be minimized in size.

Furthermore, according to Example 1 of the present invention, the urging force of the helical spring 54 is set, at the point of time when the amount of displacement of the intake valve 18 becomes minimum relative to the cam contact portion 51*a* of the tappet casing 51, so as to become larger than the urging force of the helical spring 54 for closing the intake valve 18. Therefore, the shocks to occur between the valve and the valve seat can be weakened by the urging force of the helical spring 54 right before the valve closing, whereby the collision noises can be restricted.

Furthermore, according to Example 1 of the present invention, the lift mode switching means is constituted into an element which is contained inside the tappet casing 51 and which is separate from the tappet casing 51. Therefore, there is an effect in that the VVL apparatus 50 can be minimized in size.

Still furthermore, according to Example 1 of the present invention, under operating conditions of one or both of above an intermediate speed and above an intermediate load of the engine, the lock pins 66 and the fitting holes 58 are arranged such that the amount of displacement of the intake valve 18 becomes equal to the amount of displacement of the cam contact portion 51*a* of the tappet casing 51 and that the outer tube 52 and the inner tube 53 are mechanically engaged with each other in maintaining the above-described state. Therefore, there is an effect in that the switching can be made quickly to a tappet length suitable for the high lift mode.

Furthermore, according to Example 1 of the present invention, the lock pins 66 and the fitting holes 58 are provided with the oil passage 62 so constructed and arranged that the outer tube 52 and the inner tube 53 are restricted by the supply of the hydraulic pressure, and that the restriction is released by lowering in the hydraulic pressure or by stopping of supply of the hydraulic pressure. Therefore, by utilizing the high hydraulic pressure under operating conditions of one or both of above the intermediate speed and above the intermediate load of the engine, the outer tube 52 and the inner tube 53 are restricted to thereby switch to the high lift mode. Or else, under operating conditions of one or both of below the intermediate speed and below the intermediate load of the engine, the restriction is released by the low hydraulic pressure to thereby switch to the low lift mode.

Furthermore, according to Example 1 of the present invention, there is provided a helical spring 67 which urges in the direction of releasing the restriction of the outer tube 52 and the inner tube 53 by the lock pins 66 and the fitting holes 58. Therefore, there is an effect in that the switching can be quickly made to the tappet axial length that is suitable for the low lift mode.

Still furthermore, according to Example 1 of the present invention, the outer tube 52 is provided with a communicating hole 56 which communicates the inner space 55 formed between the outer tube 52 and the inner tube 53 with an atmosphere. Therefore, there is an effect in that the back-pressure can be surely relieved to thereby improve the reliability in operation.

Furthermore, according to Example 1 of the present invention, the tappet casing 51 is contained inside a containing hole (not illustrated) beside the engine so as to be axially slidable and circumferentially rotatable. Therefore, by preventing the tappet casing 51 from being fixed (or seized), the reliability in operation and the durability in the parts can be improved. In addition, since there is no limitation in the direction in which the parts can be assembled, the assembling work can be simplified.

In Example 1 of the present invention, the outer tube 52 is provided with the ramp groove 60 as a recessed portion of the lift mode switching means, and the inner cylinder 53 is provided with the pins 68 as a projected portion. It may, however, be so arranged that the projected portion is formed in the outer tube 52 and the recessed portion is formed in the inner tube 53.

EXAMPLE 2

Figure 16:
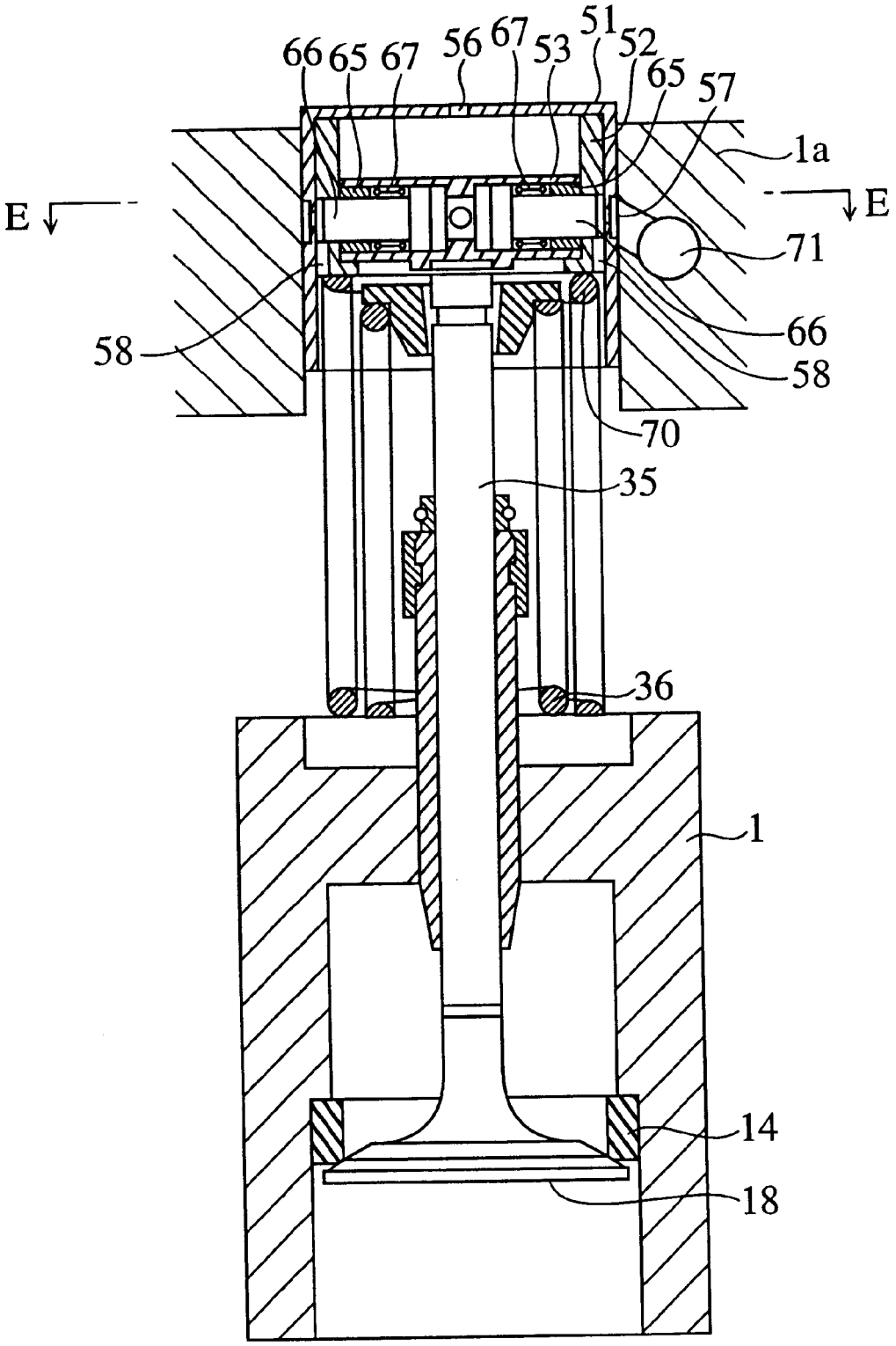
FIG. 16 is a sectional view, according to Example 2 of the present invention, showing an inner construction of the VVL apparatus in the high lift mode.
Figure 17:
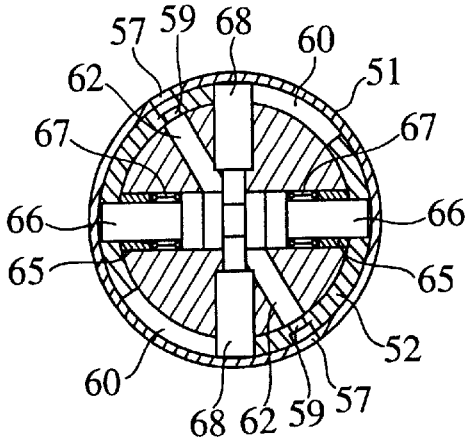
FIG. 17 is a sectional view taken along the line E—E in FIG. 16.
Figure 18:
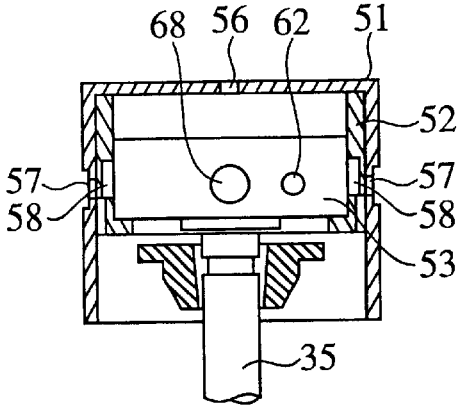
FIG. 18 is a partial sectional view showing a peripheral portion of the inner tube in the VVL apparatus in FIG. 16.
Figure 19:
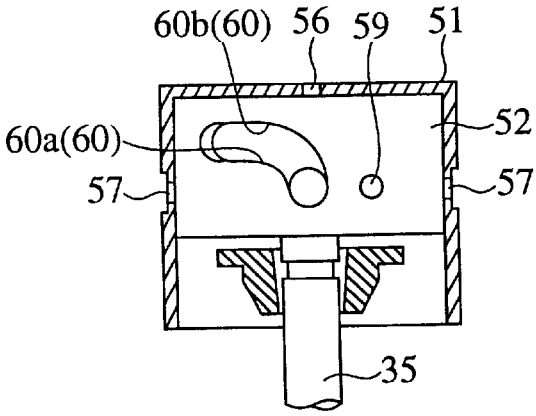
FIG. 19 is a partial sectional view showing a peripheral portion of the VVL apparatus in FIG. 16.
Figure 20:
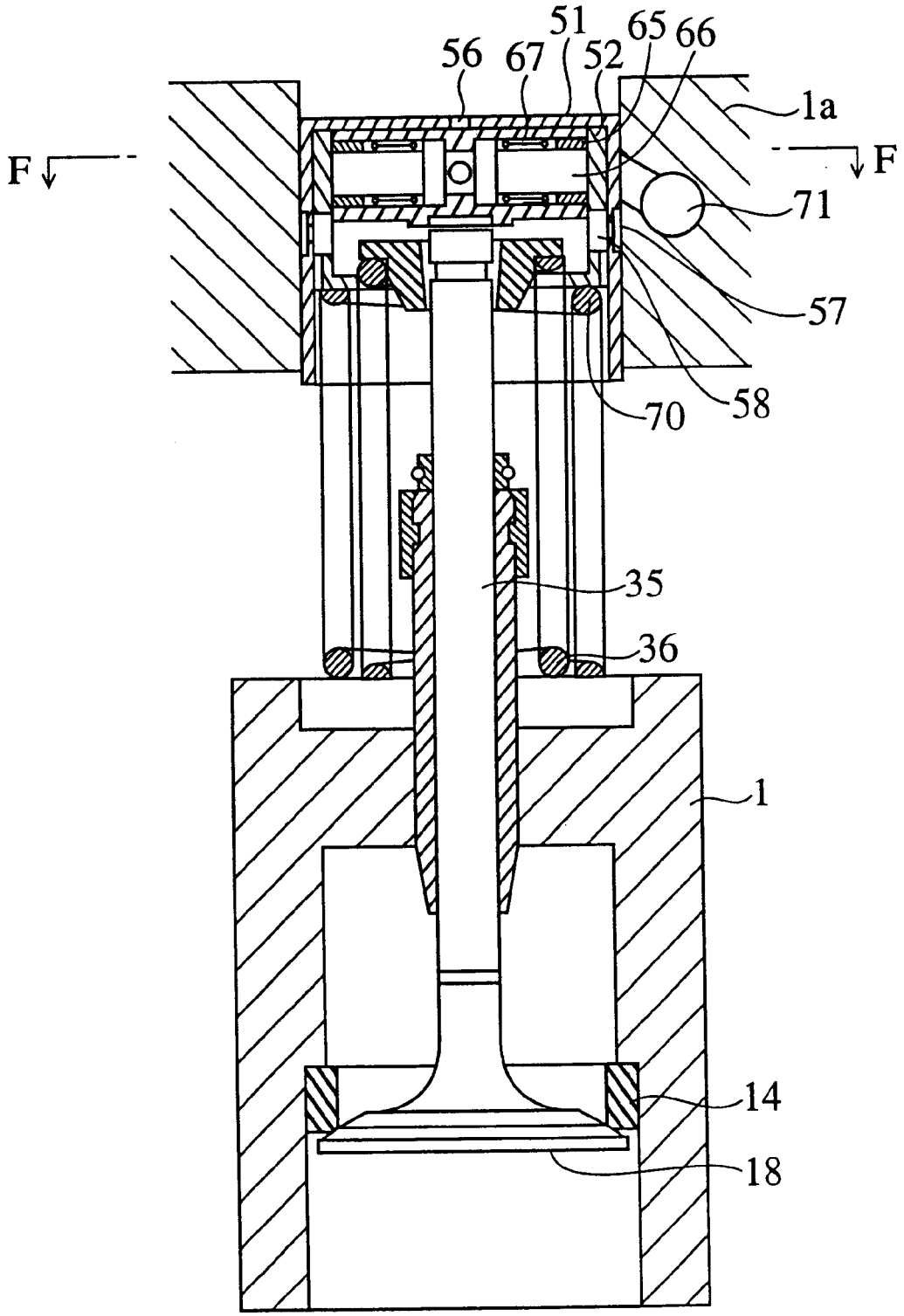
FIG. 20 is a sectional view showing an inner construction of VVL apparatus in FIG. 16 in the high lift mode.
Figure 21:
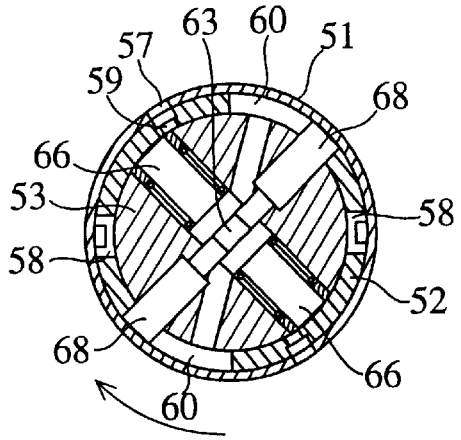
FIG. 21 is a sectional view taken along the line F—F in FIG. 16.
Figure 22:
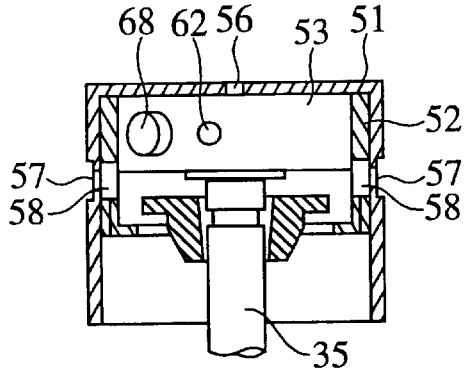
FIG. 22 is a partial sectional view showing a peripheral portion of the inner tube of the VVL apparatus in FIG. 16.
Figure 23:
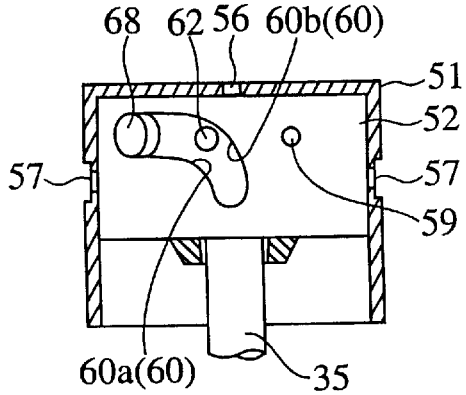
FIG. 23 is a partial sectional view showing a peripheral portion of the outer tube of the VVL apparatus in FIG. 20.
Figure 24:
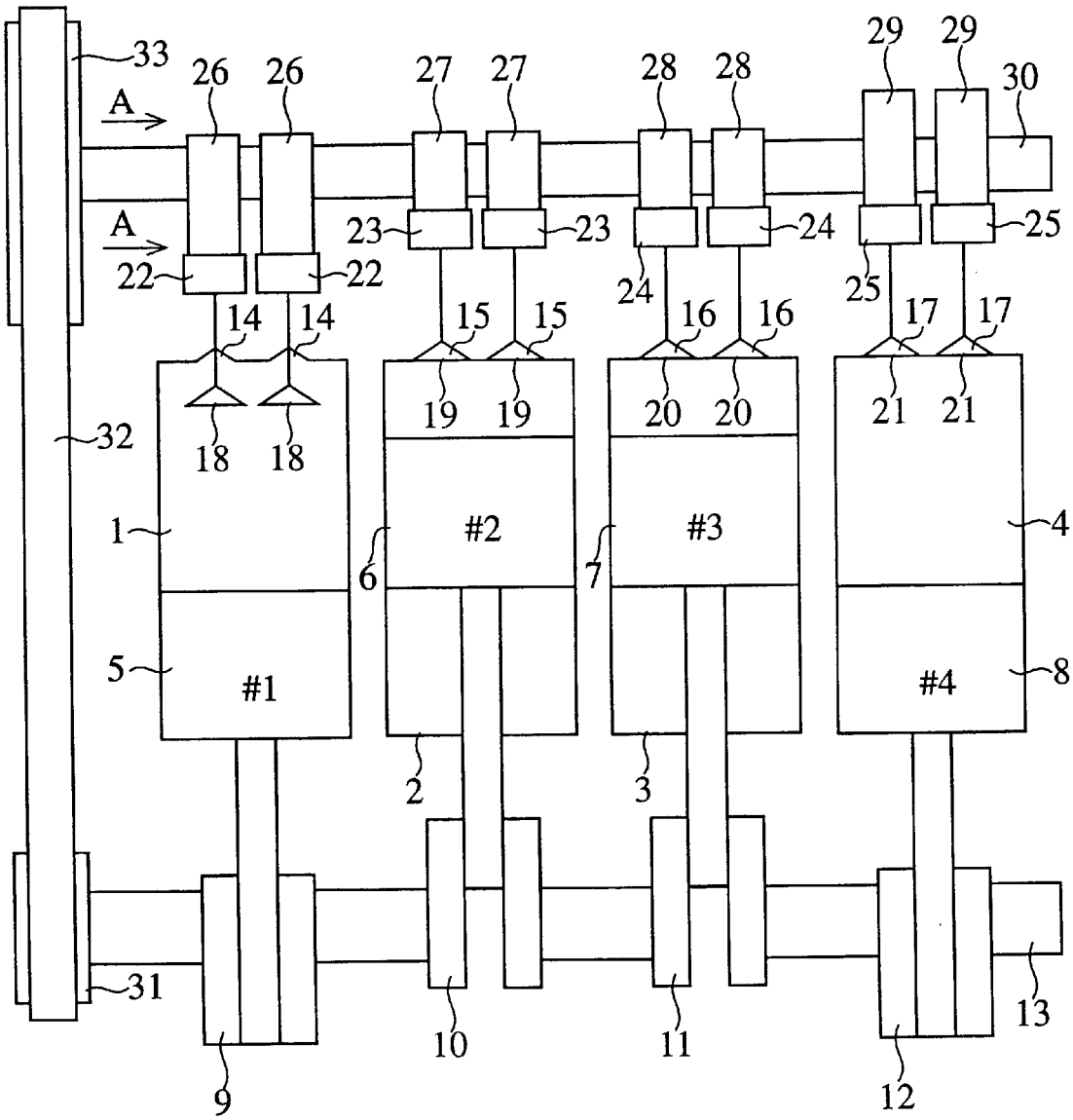
FIG. 24 is a schematic view showing an arrangement of a general valve system of an engine.
Figure 25:
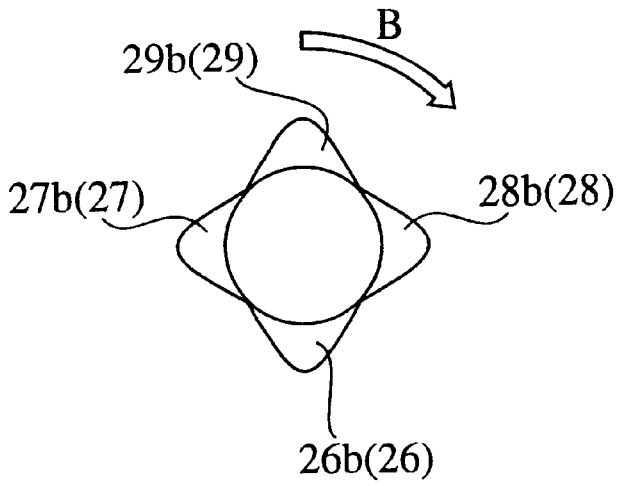
FIG. 25 is a view as seen in the direction of arrows A—A showing an arrangement of cams on a camshaft in the valve driving system in FIG. 24.
Figure 26:
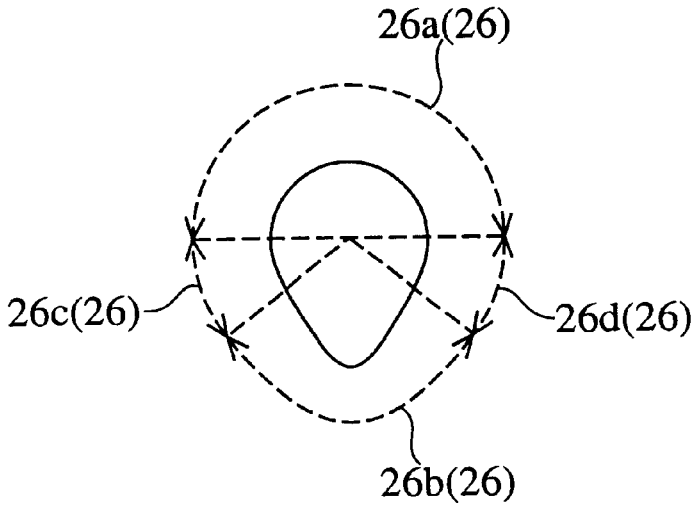
FIG. 26 is a front view showing a profile of the cam in FIG. 25.
Figures 27A, 27B, 27C, 27D, 27E, 27F, 27G, 27H:
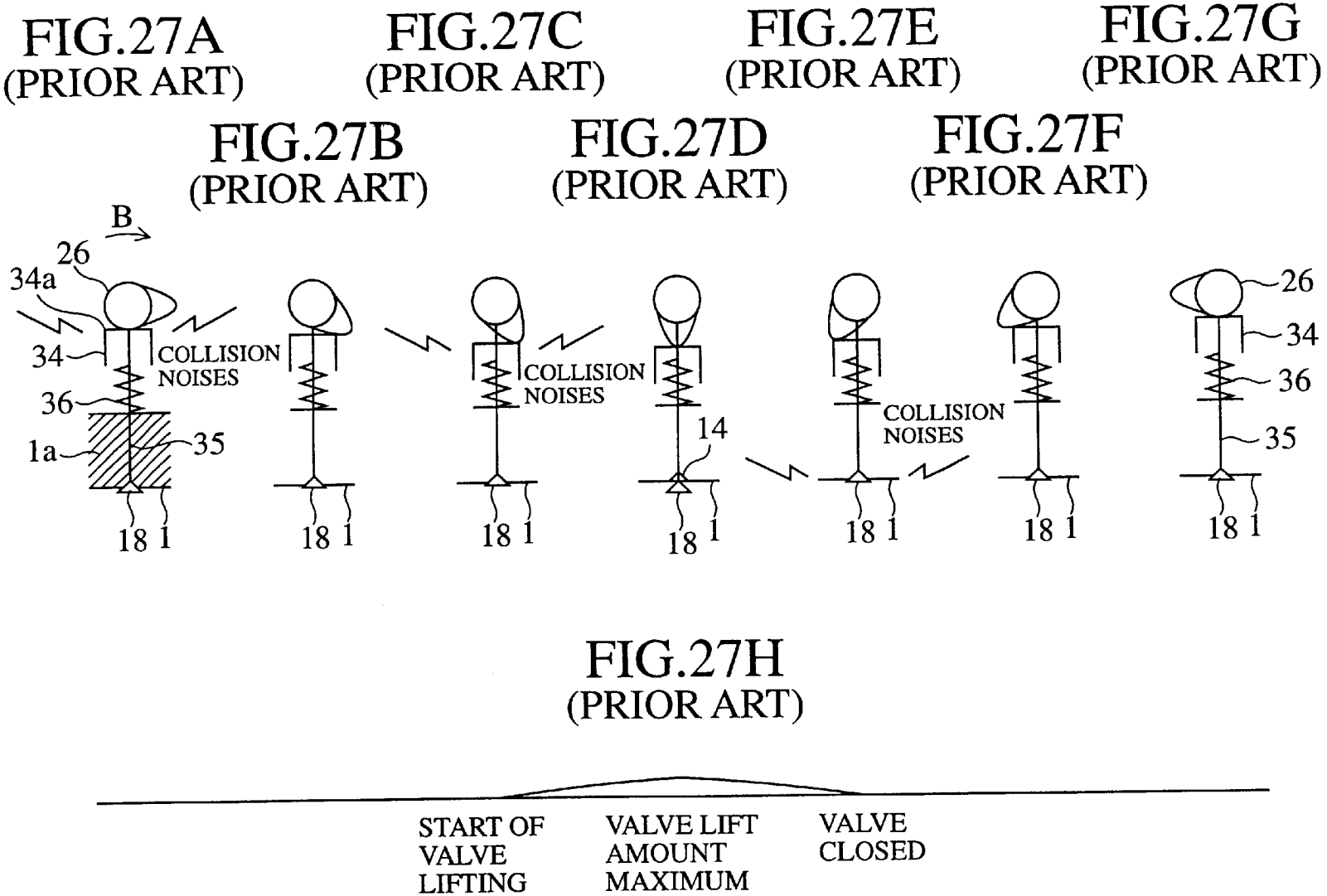
FIG.27A (PRIOR ART)
FIG.27B (PRIOR ART)
FIG.27C (PRIOR ART)
FIG.27D (PRIOR ART)
FIG.27E (PRIOR ART)
FIG.27F (PRIOR ART)
FIG.27G (PRIOR ART)
FIG.27H (PRIOR ART)
FIGS. 27A through 27G are schematic sectional views to show the conventional valve opening movement and valve closing movement of the VVL apparatus shown in FIG. 24 in a low lift mode.
FIG. 27H is a graph continuously showing the change in the valve lift amount.

FIG. 16 is a sectional view, according to Example 2 of the present invention, showing an inner construction of the VVL apparatus in the high lift mode. FIG. 17 is a sectional view taken along the line E—E in FIG. 16. FIG. 18 is a partial sectional view showing a peripheral portion of the inner tube in the VVL apparatus in FIG. 16. FIG. 19 is a partial sectional view showing a peripheral portion of the VVL apparatus in FIG. 16. FIG. 20 is a sectional view showing an inner construction of VVL apparatus in FIG. 16 in the high lift mode. FIG. 21 is a sectional view taken along the line F—F in FIG. 16. FIG. 22 is a partial sectional view showing a peripheral portion of the inner tube of the VVL apparatus in FIG. 16. FIG. 23 is a partial sectional view showing a peripheral portion of the outer tube of the VVL apparatus in FIG. 20. In the constituting elements in Example 2, those common to those in Example 1 are assigned the same reference numerals and their explanations have been omitted.

The feature of this Example 2 lies in that a helical spring 70 as the urging means is disposed between the bottom portion of the outer tube 52 and the cylinder 1, and on an outside of the valve spring 36. This helical spring 70 is to urge the outer tube 52 thereby urging the cylinder 1 in a direction of increasing the amount of displacement of the intake valve 18. As a result of employing this arrangement, there is no more need for containing the urging means inside the outer tube 52. Therefore, the axial length of the outer tube 52 is made shorter than that in Example 1. In addition, inside the cylinder head la, there is formed an oil passage 71 for supplying the hydraulic pressure to the oil chamber 63 in the inner cylinder 53.

According to Example 2 of the present invention, the outer tube 52 is constituted such that the cylinder 1 is urged by the helical spring 70 in the direction of increasing the amount of displacement of the intake valve 18. Therefore, by arbitrarily setting the urging force of the helical spring 70, only the tappet casing 51 can be axially moved in the low lift mode. As a result, the collision noises to occur between the tappet and the valve stem can be restricted.

As explained herein above, according to the present invention, since the apparatus for adjusting a valve lift is arranged to comprise: a tappet casing having a cam contact portion which comes into contact with a cam provided on a camshaft rotatably driven by a crankshaft of an internal combustion engine; lift mode switching means for selectively switching between a high lift mode in which an amount of displacement of one of an intake valve and an exhaust valve of a cylinder corresponding to the tappet casing is equal to an amount of displacement of the cam contact portion of the tappet casing, and a low lift mode in which the amount of displacement of said one of the intake valve and the exhaust valve decreases relative to the amount of displacement of the cam contact portion; restricting means for holding the lift mode switching means to the high lift mode; and urging means for urging in a direction in which the amount of displacement of the valve by the lift mode switching means increases in the low lift mode, it is possible to set the high lift mode and the low lift mode corresponding to a single cam. Therefore, as compared with the conventional apparatus employing two cams, the number of parts can be decreased and the cost can be reduced. In addition, the present invention has an effect in that a higher engine output can be attained in the high lift mode and the specific fuel consumption can be improved in the low lift mode.

Further, since the cam to contact the cam contact portion of the tappet casing is arranged to have a cam profile for a high lift cam which is suitable for operating conditions of one or both of above intermediate speed and above an intermediate load of the internal combustion engine, there is an effect in that a higher engine output can be attained in the high lift mode.

Furthermore, since the lift mode switching means is set such that, under operating conditions of one or both of below an intermediate speed and below an intermediate load of the internal combustion engine, the amount of displacement of one of the intake valve and the exhaust valve decreases relative to an amount of axial displacement of the cam contact portion of the tappet casing, there is an effect in that the specific fuel consumption in the low lift mode can be improved.

Still furthermore, since the lift mode switching means is arranged to comprise: an outer tube which is disposed inside the tappet casing; and an inner tube which is disposed inside the outer tube so as to be relatively slidable in an axial direction of the outer tube and which comes into contact with a valve stem of said one of the intake valve and the exhaust valve, there is the following effect. Namely, under predetermined operating conditions, the low lift mode and the high lift mode can be selectively switched by relatively sliding the outer tube and the inner tube in the axial direction within a predetermined range. Further, since the lift mode switching means is simplified in construction, the cost can be decreased.

Further, since the inner tube is relatively rotatable in a circumferential direction of the outer tube, the lift mode switching means can be simplified in construction and the cost can be reduced.

Still furthermore, since the inner tube has one of a projection and a recess on a periphery thereof, and the outer tube has the other of the projection and the recess which comes into engagement with said one of the projection and the recess to thereby restrict an axial movement and a circumferential movement of the outer tube, the lift mode switching means can be functioned as a shock absorbing mechanism. Therefore,there is an effect in that the collision noises to be generated at the time of valve opening and valve closing can be effectively restricted.

Further, since the projection is constituted into a pin having a substantially circular cross section, and the recess is constituted into a groove having a shape engageable with the pin, the engagement between the recess and the projection can be surely made. Therefore, there is an effect in that the reliability in operation and the durability of parts can be improved.

Still furthermore, since the recess has a substantially arcuate shape which is capable of gradually converting the movement of one of the inner tube and the outer tube having the projection from the axial sliding to the circumferential rotation, the axial shock at the time of valve opening and valve closing can be released in the circumferential direction, with the result that the collision noises can be effectively restricted.

Furthermore, since the recess in the lift mode switching means is an arcuate groove of secondary degree so constructed and arranged that, when one of the intake valve and the exhaust valve operates in a direction of reducing the amount of displacement of the valve, the closer to a position of maximum decrease in the amount of displacement of the valve, the more rapid increase in an amount of circumferential displacement of the inner tube relative to the outer tube, the axial shocks at the time of valve opening and valve closing can be released in the circumferential direction, with the result that the collision noises can be effectively restricted.

Further, since the outer tube is urged by urging means to urge the inner tube in a direction of increasing the amount of displacement of one of the intake valve and the exhaust valve, only the tappet casing can be axially moved in the low lift mode by arbitrarily setting the urging force. Therefore, the collision noises to be generated between the tappet and the valve stem can be restricted.

Still furthermore, since the outer tube is urged by urging means to urge the cylinder in a direction of increasing the amount of displacement of one of the intake valve and the exhaust valve, only the tappet casing can be axially moved in the low lift mode by arbitrarily setting the urging force. Therefore, the collision noises to be generated between the tappet and the valve stem can be restricted.

Further, since the urging means is disposed between a head portion of the outer tube and a head portion of the inner tube, there is an effect in that the VVL apparatus can be minimized in size.

Furthermore, since an urging force of the urging means is set, at a point of time when the amount of displacement of one of the intake valve and the exhaust valve becomes minimum relative to the amount of displacement of the contact portion of the tappet casing, so as to become larger than an urging force of a valve spring for closing the other of the intake valve and the exhaust valve, the shocks between the valve and the valve seat can be weakened by the urging force of the urging means right before the valve closing, thereby restricting the collision noises.

Still furthermore, since the lift mode switching means is constituted into an element which is contained inside the tappet casing and which is separate from the tappet casing, the VVL apparatus can be minimized in size.

Furthermore, since the restricting means mechanically engage the outer tube and the inner tube together when, under one of operating conditions of above an intermediate speed and above an intermediate load of the internal combustion engine, the amount of displacement of one of the intake valve and the exhaust valve is equal to the amount of displacement of the cam contact portion of the tappet casing and when a state thereof is maintained, there is an effect in that the switching to the tappet length which is suitable for the high lift mode can be quickly performed.

Still furthermore, since the restricting means has an oil passage so constructed and arranged that the outer tube and the inner tube of the lift mode switching means are restricted by a supply of hydraulic pressure and that the restriction is released by lowering in the hydraulic pressure or by stopping of supply of the hydraulic pressure, the outer tube and the inner tube are restricted by utilizing the high hydraulic pressure under operating conditions of one or both of above the intermediate speed and above the intermediate load of the engine, thereby switching to the high lift mode. Otherwise, the above-described restriction is released by the low hydraulic pressure under operating conditions of one or both of below the intermediate speed and below the intermediate load of the engine, thereby switching to the low speed mode.

Still furthermore, since the apparatus further comprises mechanical urging means for urging in a direction of releasing the restriction of the lift mode switching means, there is an effect in that the switching to the tappet axial length suitable for the low lift mode can be quickly made.

Furthermore, since the outer tube of the lift mode switching means has a communicating hole which communicates a space formed between the outer tube and the inner tube with an atmosphere, the back pressure can be surely relieved, with the result that the reliability in operation can be improved.

Furthermore, since the tappet casing is contained inside a containing hole beside the internal combustion engine so as to be axially slidable and circumferentially rotatable, the tappet casing can be prevented from being fixed or clogged. There is an effect in that the reliability in operation and the durability of parts can be improved. In addition, since there is no direction in which the parts can be assembled, the assembly work can be simplified.

It is readily apparent that the above-described apparatus for adjusting a valve lift meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An apparatus for adjusting a valve lift, comprising:

a tappet casing having a cam contact portion which comes into contact with a cam provided on a camshaft rotatably driven by a crankshaft of an internal combustion engine;

lift mode switching means for selectively switching between a high lift mode in which an amount of displacement of one of an intake valve and an exhaust valve of a cylinder corresponding to said tappet casing is equal to an amount of displacement of said cam contact portion of said tappet casing, and a low lift mode in which the amount of displacement of said one of the intake valve and the exhaust valve decreases relative to the amount of displacement of said cam contact portion;

restricting means for holding said lift mode switching means to the high lift mode; and urging means for urging in a direction in which the amount of displacement of the valve by said lift mode switching means increases in the low lift mode.

2. The apparatus according to claim 1, wherein the cam to contact the cam contact portion of said tappet casing has a cam profile for a high lift cam which is suitable for operating conditions of one or both of above an intermediate speed and above an intermediate load of the internal combustion engine.

3. The apparatus according to claim 1, wherein said lift mode switching means is set such that, under operating conditions of one or both of below an intermediate speed and below an intermediate load of the internal combustion engine, the amount of displacement of one of the intake valve and the exhaust valve decreases relative to an amount of axial displacement of said cam contact portion of said tappet casing.

4. The apparatus according to claim 1, wherein said lift mode switching means comprises:

an outer tube which is disposed inside said tappet casing; and an inner tube which is disposed inside said outer tube so as to come into contact with a valve stem of said one of the intake valve and the exhaust valve.

5. The apparatus according to claim 4, wherein said inner tube is relatively slidable in an axial direction of said outer tube and is relatively rotatable in a circumferential direction of said outer tube.

6. The apparatus according to claim 4, wherein said inner tube has one of a projection and a recess on a periphery thereof and wherein said outer tube has the other of the projection and the recess which comes into engagement with said one of the projection and the recess to thereby restrict an axial movement and a circumferential movement of said outer tube.

7. The apparatus according to claim 6, wherein said projection is a pin having a substantially circular cross section, and wherein said recess is a groove having a shape engageable with said pin.

8. The apparatus according to claim 6, wherein said recess has a substantially arcuate shape which is capable of gradually converting the movement of one of said inner tube and said outer tube having the projection from the axial sliding to the circumferential rotation.

9. The apparatus according to claim 6, wherein said recess in said lift mode switching means is an arcuate groove of a curve of secondary degree so constructed and arranged that, when one of the intake valve and the exhaust valve operates in a direction of reducing the amount of displacement of the valve, the closer to a position of maximum decrease in the amount of displacement of the valve, the more rapid increase in an amount of relative circumferential displacement of said inner tube relative to said outer tube.

10. The apparatus according to claim 4, wherein said outer tube is urged by urging means to urge said inner tube in a direction of increasing the amount of displacement of one of the intake valve and the exhaust valve.

11. The apparatus according to claim 4, wherein said outer tube is urged by urging means to urge the cylinder in a direction of increasing the amount of displacement of one of the intake valve and the exhaust valve.

12. The apparatus according to claim 10, wherein said urging means is disposed between a head portion of said outer tube and a head portion of said inner tube.

13. The apparatus according to claim 11, wherein an urging force of said urging means is set, at a point of time when the amount of displacement of one of the intake valve and the exhaust valve becomes minimum relative to the amount of displacement of said contact portion of said tappet casing, so as to become larger than an urging force of a valve spring for closing the other of the intake valve and the exhaust valve.

14. The apparatus according to claim 4, wherein said lift mode switching means is constituted into an element which is contained inside said tappet casing and which is separate from said tappet casing.

15. The apparatus according to claim 4, wherein said restricting means mechanically engage said outer tube and said inner tube together when, under one of operating conditions of above an intermediate speed and above an intermediate load of the internal combustion engine, the amount of displacement of one of the intake valve and the exhaust valve is equal to the amount of displacement of the cam contact portion of the tappet casing and when a state thereof is maintained.

16. The apparatus according to claim 15, wherein said restricting means has an oil passage so constructed and arranged that the outer tube and the inner tube of said lift mode switching means are restricted by a supply of hydraulic pressure and that the restriction is released by lowering in the hydraulic pressure or by stopping of supply of the hydraulic pressure.

17. The apparatus according to claim 16, further comprising mechanical urging means for urging in a direction of releasing the restriction of said lift mode switching means.

18. The apparatus according to claim 4, wherein said outer tube of said lift mode switching means has a communicating hole which communicates a space formed between said outer tube and said inner tube with an atmosphere.

19. The apparatus according to claim 1, wherein said tappet casing is contained inside a containing hole beside the internal combustion engine so as to be axially slidable and circumferentially rotatable.

* * * * *